US007871946B2

(12) United States Patent
Tsujimoto et al.

(10) Patent No.: US 7,871,946 B2
(45) Date of Patent: Jan. 18, 2011

(54) NONWOVEN FABRIC COMPOSED OF ULTRA-FINE CONTINUOUS FIBERS, AND PRODUCTION PROCESS AND APPLICATION THEREOF

(75) Inventors: Takuya Tsujimoto, Kurashiki (JP); Naoki Fujiwara, Kurashiki (JP); Midori Okazaki, Kurashiki (JP); Nozomu Sugo, Kurashiki (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 41 days.

(21) Appl. No.: 10/949,452

(22) Filed: Sep. 27, 2004

(65) Prior Publication Data

US 2005/0079781 A1 Apr. 14, 2005

(30) Foreign Application Priority Data

Oct. 9, 2003 (JP) ..... 2003-350658

(51) Int. Cl.
*D04H 1/00* (2006.01)
*B29D 28/00* (2006.01)
*B32B 1/00* (2006.01)
*B32B 15/04* (2006.01)

(52) U.S. Cl. ..... 442/361; 442/363; 264/103; 264/172.13; 264/172.16

(58) Field of Classification Search ..... 428/903, 428/96; 442/347, 352, 356, 334, 361, 363; 264/103, 172.13, 172.16
See application file for complete search history.

(56) References Cited

U.S. PATENT DOCUMENTS 3,399,521 A * 9/1968 Thoma et al. ..... 57/282

(Continued)

FOREIGN PATENT DOCUMENTS

EP 1 046 747 A1 10/2000

(Continued)

OTHER PUBLICATIONS

U.S. Appl. No. 12/442,124, filed Mar. 20, 2009, Tsujimoto, et al.

*Primary Examiner*—Angela Ortiz
*Assistant Examiner*—Jennifer Steele
(74) *Attorney, Agent, or Firm*—Oblon, Spivak, McClelland, Maier & Neustadt, L.L.P.

(57) ABSTRACT

A nonwoven fabric composed of ultra-fine continuous fibers having a mean fineness of not more than 0.5 dtex is prepared. The nonwoven fabric comprises a water-soluble thermoplastic resin in a proportion of not more than 5% by weight relative to the nonwoven fabric, has an absorbing height of not less than 30 mm as determined at 20° C. after 10 minutes based on Byreck method when the nonwoven fabric immersion-treated for 60 minutes in a water of 80° C. is used, and satisfies the following formula: $(B)/(A) \geqq 0.25$, wherein the symbol (B) represents a tensile strength [N/5 cm] in the longitudinal direction and the lateral direction of the nonwoven fabric and the symbol (A) represents a fabric weight [g/m] of the nonwoven fabric. In the nonwoven fabric, not less than 30% of the surface may be coated with the water-soluble thermoplastic resin. The water-soluble thermoplastic resin may be a water-soluble thermoplastic polyvinyl alcohol, e.g., a modified polyvinyl alcohol containing an ethylene unit in a proportion of 3 to 20 mol %.

The present invention provides a nonwoven fabric composed of ultra-fine continuous fibers, having a high flexibility or softness, and having a high mechanical strength even when the fiber diameter is small, and having an excellent water absorbency, as well as a production process and an application thereof.

26 Claims, 3 Drawing Sheets

U.S. PATENT DOCUMENTS

| | | | | | |
|---|---|---|---|---|---|
| 3,619,316 | A | | 11/1971 | Ishida et al. | |
| 4,147,574 | A | * | 4/1979 | Setsuie et al. | 156/62.4 |
| 4,476,186 | A | * | 10/1984 | Kato et al. | 442/60 |
| 5,041,252 | A | * | 8/1991 | Fujii et al. | 264/176.1 |
| 5,366,832 | A | * | 11/1994 | Hayashi et al. | 429/249 |
| 6,624,100 | B1 | * | 9/2003 | Pike | 442/340 |
| 2003/0124938 | A1 | * | 7/2003 | Zafiroglu et al. | 442/328 |
| 2003/0166370 | A1 | * | 9/2003 | Harris et al. | 442/356 |

FOREIGN PATENT DOCUMENTS

| | | | |
|---|---|---|---|
| JP | 48-31955 | | 10/1973 |
| JP | 7-102463 | | 4/1995 |
| JP | 7-258964 | | 10/1995 |
| JP | 2000-248431 | | 9/2000 |
| JP | 2001-262456 | | 9/2001 |
| JP | 2001-265456 | * | 9/2001 |
| JP | 2003-073970 | | 12/2003 |
| TW | 330947 | | 5/1998 |
| TW | 477836 | | 3/2002 |
| WO | WO 2004/058374 A2 | | 7/2004 |

* cited by examiner

NONWOVEN FABRIC COMPOSED OF ULTRA-FINE CONTINUOUS FIBERS, AND PRODUCTION PROCESS AND APPLICATION THEREOF

FIELD OF THE INVENTION

The present invention relates to a nonwoven fabric composed of ultra-fine (or extrafine) continuous fibers, and a production process and application thereof. More specifically, the present invention relates to a nonwoven fabric in which part of a water-soluble thermoplastic resin (e.g., a water-soluble thermoplastic polyvinyl alcohol) contained in an untreated conjugate continuous fiber is retained in the fiber after the ultra-fine treatment, and a production process thereof, and an application comprising the nonwoven fabric, such as a wiper, a filter, a battery (or cell) or capacitor separator.

BACKGROUND OF THE INVENTION

Nonwoven fabrics composed of ultra-fine fibers have a large surface area and are excellent in liquid absorbency, softness. (or flexibility), filtration property (or ability) or others, and are widely used in a variety of applications.

Examples of an efficient production process of a nonwoven fabric, being directly related to melt spinning, include a spunbonded process and a meltblown process. A conventional nonwoven fabric composed of continuous (or filament) fibers, produced by a common spunbonded process, has an excellent mechanical strength, but is small in surface area because of large fiber diameter thus short of liquid absorbency, flexibility and filtration property. Compared with the spunbonded nonwoven fabric, a meltblown nonwoven fabric is small in fiber diameter, and as a result is excellent in flexibility and achieves a large surface area. By making use of such properties or abilities, the meltblown nonwoven fabric has been widely utilized for applications such as a wiper material and a filter substrate. However, the meltblown nonwoven fabric is low in mechanical strength by itself, and therefore is generally used by laminating a spunbonded nonwoven fabric or the like as a supporting layer thereon.

Moreover, a process is known as a production process of a nonwoven fabric composed of ultra-fine continuous fibers, where the process comprises subjecting a nonwoven fabric composed of conjugate continuous fibers of two or more kinds of polymers to separate or split application along the direction of fiber length by a physical or chemical technique to transform thus obtained conjugate continuous fibers into ultra-fine continuous fibers. However, in this process, two or more kinds of polymers are present in the nonwoven fabric. Thus, a nonwoven fabric composed of ultra-fine continuous fibers of only one polymer, can be obtained by removing the other polymer(s) with the use of chemical(s). However, since the remaining polymer without being removed is adversely affected in the removing process, a combination of polymers constituting the conjugate fiber is limited to a specific one in many cases.

On the other hand, a polyvinyl alcohol (hereinafter the term is sometimes abbreviated PVA) is a water-soluble polymer, and it is known that the degree of water solubility in the PVA can be changed based on a basic bone structure thereof, a molecular structure thereof, a form thereof and various modification. Further, the PVA is identified as having biodegradability. The harmony between synthetic products and natural world has been a major problem recently in global environment, and the PVA and PVA-series fibers having such basic performances have become a center of attraction.

The inventors of the present invention proposed in Japanese Patent Application Laid-Open No. 262456/2001 (JP-2001-262456A) a process for producing conjugate continuous fibers composed of a PVA and other thermoplastic polymer by melt spinning and simultaneously making the obtained conjugate continuous fibers into a nonwoven fabric; and a nonwoven fabric composed of continuous fibers, having a modified cross-sectional form (or shape) or a ultra-fine fineness, obtained by extractive removing the PVA from the nonwoven fabric with water.

However, this document is silent on retaining part of the PVA in the fabric. Moreover, the document also silent that a nonwoven fabric composed of the conjugate continuous fibers, having a water absorbency with a high durability unpredictable from ordinary common sense, can be obtained depending on the condition for retaining the PVA. The conventional extractive treatment condition with water, that is, a method which comprises repeating an extractive treatment using a hot water and a severe stirring many times, and further dry treating at heat temperatures, cannot provide the water absorbency with a high durability.

SUMMARY OF THE INVENTION

It is therefore an object of the present invention to provide a nonwoven fabric composed of ultra-fine continuous fibers, having a high flexibility or softness, and having a high mechanical strength even when the fiber diameter is small, and having an excellent water absorbency, as well as a production process and an application thereof.

It is another object of the present invention to provide a nonwoven fabric composed of ultra-fine continuous fibers, having an excellent water absorbency with a high durability, and a production process and an application thereof.

It is still another object of the present invention to provide a nonwoven fabric composed of ultra-fine continuous fibers, having a high flexibility and a high liquid absorbency, a production process and an application thereof, by using a spunbonded process.

The inventors of the present invention made intensive studies to achieve the above objects, and finally found that a nonwoven fabric composed of ultra-fine continuous fibers, having a water absorbency with a high durability and a high mechanical strength and being excellent in flexibility, can be obtained by extractive removing a water-soluble thermoplastic resin from a nonwoven fabric composed of conjugate continuous fibers of the water-soluble thermoplastic resin and a water-insoluble thermoplastic resin and made by melt spinning (so-called a spunbonded nonwoven fabric) under a specific condition to make the conjugate continuous fiber ultra-fine.

That is, the nonwoven fabric composed of ultra-fine continuous fibers of the present invention is composed of ultra-fine (or extrafine) continuous fibers having a mean fineness of not more than 0.5 dtex, comprises a water-soluble thermoplastic resin in a proportion of not more than 5% by weight relative to the nonwoven fabric, has an absorbing height of not less than 30 mm as determined at 20° C. after 10 minutes based on Byreck method when the nonwoven fabric immersion-treated for 60 minutes in a water of 80° C. is used, and satisfies the following formula:

$$(B)/(A) \geqq 0.25$$

wherein the symbol (B) represents a tensile strength [N/5 cm] in the longitudinal direction and the lateral direction of the nonwoven fabric and the symbol (A) represents a fabric weight [g/m$^2$] of the nonwoven fabric.

In the nonwoven fabric composed of ultra-fine continuous fibers, not less than 30% of the surface may be coated with the water-soluble thermoplastic resin. The water-soluble thermoplastic resin may be a water-soluble thermoplastic polyvinyl alcohol, for example, a modified polyvinyl alcohol containing at least one unit, in a proportion of 0.1 to 20 mol %, selected from the group of an α-olefin unit having a carbon number of not more than 4 and a vinyl ether unit (in particular, containing an ethylene unit in a proportion of 3 to 20 mol %). The proportion of the water-soluble thermoplastic resin relative to the nonwoven fabric may be about 0.001 to 5% by weight. The nonwoven fabric of the present invention may be partially thermocompressed, and maintain the form of nonwoven fabric. Moreover, the nonwoven fabric of the present invention may be entangled by jetting (or spraying) a pressurized water. Further, the nonwoven fabric of the present invention may comprise a thermoplastic resin, e.g., a polyester-series resin, a polyamide-series resin, a polyolefinic resin, a modified polyvinyl alcohol containing an ethylene unit of 25 to 70 mol %. Furthermore, the nonwoven fabric of the present invention may be formed from a bundle of the ultra-fine continuous fibers (in particular ultra-fine continuous fibers each having a fine or minute crimp).

The present invention also includes a laminate comprising the nonwoven fabric composed of ultra-fine continuous fibers and other nonwoven fabric.

Moreover, the present invention includes a process for producing a nonwoven fabric composed of ultra-fine continuous fibers having a mean fineness of not more than 0.5 dtex, which comprises preparing a nonwoven fabric or nonwoven web composed of conjugate continuous fibers of the water-soluble thermoplastic resin and a water-insoluble thermoplastic resin, and removing the water-soluble thermoplastic resin from the nonwoven fabric or nonwoven web, wherein most of the water-soluble thermoplastic resin is dissolved in a hydrophilic solvent for removing from the nonwoven fabric or nonwoven web to retain part of the water-soluble thermoplastic resin in the nonwoven fabric or nonwoven web (for example, to retain the water-soluble thermoplastic resin in a proportion of not more than 5% by weight relative to the nonwoven fabric or nonwoven web). In this process, the conjugate continuous fiber may has a conjugate structure, in a cross section, comprising an ultra-fine fiber component composed of the water-insoluble thermoplastic resin, and a water-soluble thermoplastic resin for separating or splitting the component into a plurality of isolated sections.

The water-soluble thermoplastic resin may be retained in a proportion of 0.001 to 5% by weight relative to the nonwoven fabric. Moreover, the nonwoven fabric or nonwoven web may be dried at a temperature not higher than 120° C. after removing most of the water-soluble thermoplastic resin with the hydrophilic solvent. Further, the removal of the water-soluble thermoplastic resin may be conducted using about 100 to 2000 parts by weight of the hydrophilic solvent relative to 1 part by weight of the nonwoven fabric. Furthermore, in removing most of the water-soluble thermoplastic resin, the dissolving treatment may comprise a step for dipping the nonwoven fabric or nonwoven web in the hydrophilic solvent of a temperature not higher than 50° C., a step for gradually increasing the temperature of the hydrophilic solvent, and a step for heat-treating the nonwoven fabric or nonwoven web in the hydrophilic solvent at a temperature of 80 to 120° C. for 5 minutes to 10 hours.

Further, the preferred applications of such a nonwoven fabric includes a wiper, a filter material and a battery (or cell) or capacitor separator, which are formed from such a nonwoven fabric, and a battery (or cell) or capacitor comprising the battery (or cell) or capacitor separator.

The method for producing a nonwoven fabric composed of ultra-fine continuous fibers having an excellent water absorbency includes a method which comprises applying (or adding) an aqueous solution of a water-soluble thermoplastic resin (e.g., a PVA) and drying the solution to a nonwoven fabric composed of ultra-fine continuous fibers. However, in this method, the applied (or added) water-soluble thermoplastic resin is left out easily by water, and it is impossible to ensure an objective excellent water absorbency with a high durability in the present invention. Moreover, in this method, in order to inhibit easy falling off of the water-soluble thermoplastic resin by water, it is also suggested that the water absorbency with a high durability of the applied (or added) water-soluble thermoplastic resin is improved by adopting the high temperature such that the water-soluble thermoplastic resin is crystallized, as a condition of drying the applied (or added) aqueous solution of the water-soluble thermoplastic resin. However, in such a method, the water absorbency of the water-soluble thermoplastic resin after crystallization is deteriorated, and accordingly enough water absorbency cannot be obtained by these common methods.

It is estimated the reason why the nonwoven fabric composed of ultra-fine continuous fibers of the present invention has an excellent water absorbency with a high durability is that the water-soluble thermoplastic resin is in the state of having difficulty in falling off from the surface of the ultra-fine fiber by extractive removing the water-soluble thermoplastic resin with a hydrophilic solvent (such as water). The difficulty of falling off is caused by the following reasons: since the water-soluble thermoplastic resin (e.g., a PVA) is one component constituting a fiber in the step of a conjugate fiber before making a ultra-fine fiber, there is any bonds between the water-soluble thermoplastic resin and a water-insoluble thermoplastic resin constituting the fiber; and further the water-insoluble thermoplastic resin after removing the water-soluble thermoplastic resin becomes a ultra-fine fiber and the water-soluble thermoplastic resin is mainly present in the ultra-fine fiber or in the inmost recesses of thin voids between fibers. Further, in the present invention, it is supposed that the drying treatment at the temperature condition such that the water-soluble thermoplastic resin is hardly to be crystallized after removing the water-soluble thermoplastic resin with the hydrophilic solvent prevents any loss of the water absorbency of the water-soluble thermoplastic resin.

Generally, in removing one component from a conjugate fiber, a method which comprises washing the fiber again and again with a solvent of high temperature under a strong stirring condition and drying the fiber at a high temperature at last to increase the removing rate is employed. However, in the case of adopting such the conventionally employed removing condition, the water-soluble thermoplastic resin does not remain in the fiber so that water absorbency is brought out. Even if the resin remains, the resin is crystallized in drying, therefore it is impossible to obtain the water absorbency with a high durability satisfying the object of the present invention.

DETAILED DESCRIPTION OF THE INVENTION

Figure 1:
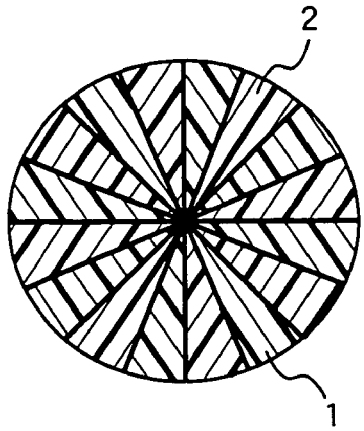
FIG. 1 is a sectional view showing an embodiment of a cross-sectional form (or shape) of a conjugate continuous fiber used in the present invention.

The present invention shall now be described in detail.

In the present invention, it is necessary that an ultra-fine continuous fiber composed of a water-insoluble thermoplastic resin have a fineness of not more than 0.5 dtex on the average. For example, the fiber has a fineness of not more than 0.4 dtex (e.g., 0.001 to 0.4 dtex) on the average, preferably not more than 0.3 dtex (e.g., 0.01 to 0.3 dtex) on the average, and more preferably not more than 0.25 dtex (e.g., 0.05 to 0.25 dtex) on the average. In the case where the average fineness of the ultra-fine continuous fiber is more than 0.5 dtex, the fiber cannot be made ultra fine and decreases in the surface area. Additionally, flexibility or softness, liquid absorbency and others are remarkably deteriorated. Moreover, the lower limit of the fineness is not particularly limited to a specific one. From the viewpoint of the easiness of production, the lower limit of the fineness is preferably 0.001 dtex.

The nonwoven fabric of the present invention comprises continuous fibers. The nonwoven fabric composed of continuous fibers has an extremely high productivity compared with other nonwoven fabric, for example, a dry-laid nonwoven fabric obtained by hydroentangling or needle-punching a web composed of staple fibers or a wet-laid nonwoven fabric obtained by a paper-making method from a shortcut fiber dispersed in water. Further, since the nonwoven fabric comprises a continuous fiber, the nonwoven fabric is hard to induce falling off of the fiber from the nonwoven fabric, and demonstrates beneficial effects in an application in which falling off of the fiber is undesirable, such as a wiper, a filter, and a battery or capacitor separator. Furthermore, the strength of the nonwoven fabric is generally higher than that of a nonwoven fabric composed of staple fibers or that of nonwoven fabric composed of shortcut fibers. Also from such a point, the nonwoven fabric is suitable for an application required having strength, such as a wiper, a filter, and a battery or capacitor separator.

It is necessary that the tensile strength (B) [N/5 cm] of the longitudinal direction and the lateral direction in the nonwoven fabric composed of ultra-fine continuous fibers of the present invention satisfies the following formula relative to the fabric weight (A) [g/m$^2$]: $(B)/(A) \geqq 0.25$, for example, $(B)/(A) \geqq 0.3$ (e.g., $10 \geqq (B)/(A) \geqq 0.3$), preferably $(B)/(A) \geqq 0.4$ (e.g., $5(B)/(A) \geqq 0.4$), and more preferably $(B)/(A) \geqq 0.5$ (e.g., $3\ (B)/(A) \geqq 0.5$). In the case of $(B)/(A) < 0.25$, the nonwoven fabric is insufficient in strength and cannot fulfill enough function by itself.

On the other hand, it is preferred that the tensile strength (B) [N/5 cm] and the fabric weight (A) [g/m $^2$] satisfies the formula $(B)/(A) \leqq 10$. In the case where the ratio (B)/(A) is too large, the softness (or flexibility) of the nonwoven fabric is deteriorated in some cases. Incidentally, the ratio (B)/(A) can be changed depending on a mean fineness, a drawing rate of fiber spinning, a thermocompression and entanglement condition, and others. To be more precise, the ratio (B)/(A) can be enhanced by making the mean fineness larger, making the drawing rate of fiber spinning larger, or reinforcing the thermocompression and entanglement condition.

The great advantage of the nonwoven fabric composed of ultra-fine fibers of the present invention is that the water absorbency thereof is controlled by retaining part of the water-soluble thermoplastic resin in the nonwoven fabric. More specifically, it is necessary that, in the nonwoven fabric of the present invention, the absorbing height as determined at 20° C. after 10 minutes based on Byreck method is not less than 30 mm when the nonwoven fabric immersion-treated in water of 80° C. for 60 minutes is used. For example, the absorbing height is not less than 50 mm (e.g., 50 to 300 mm), preferably not less than 60 mm (e.g., 60 to 250 mm), and more preferably not less than 70 mm (e.g., 70 to 200 mm). Incidentally, the nonwoven fabric having an absorbing height of less than 30 mm cannot fulfill enough water-absorbing function, so it is difficult to use the nonwoven fabric as an application requiring water absorbency, e.g., a filter, a wiper, and a battery separator. Such an improved liquid absorbency with a high durability is achieved by retaining a water-soluble thermoplastic resin in a nonwoven fabric composed of ultra-fine fibers having a specific fineness, and if necessary drying the nonwoven fabric under a certain condition and calendering the dried product under a certain condition. However, it is difficult to produce a nonwoven fabric whose absorbing height is over 300 mm.

The absorbing height of the nonwoven fabric is determined in accordance with Japanese Industrial Standards (JIS) L1018-70 "Knit fabric test method" (Water absorbency B method (Byreck method) KRT No. 411-2). That is, the absorbing height can be evaluated as a risen distance (or height) of water absorbed by the following manner: which comprises attaching a load to the lower end of a nonwoven fabric of 2.5 cm by 32 cm, submerging the fabric sample in an aqueous ink (ink/water=1/5) so that one-centimeter width from the bottom is soaked in the aqueous ink, and maintaining the fabric sample for 10 minutes in such a state. Incidentally, before the above evaluation, the nonwoven fabric used for measuring the absorbing height is treated by the following manner: heating 1000 parts by weight of a water relative to 1 part by weight of the nonwoven fabric to 80° C., immerging about 20 g of the fabric in the water, allowing the fabric to stand for 60 minutes under a gentle stirring, then taking the fabric out of the water, washing the surface of the fabric with another water of 20° C., and drying the fabric in this state at 80° C. for 3 minutes.

It is necessary that the proportion of the water-soluble thermoplastic resin contained in the nonwoven fabric composed of ultra-fine continuous fibers of the present invention is not more than 5% by weight relative to the nonwoven fabric. For example, the proportion is about 0.001 to 5% by weight, preferably 0.01 to 4% by weight, more preferably about 0.03 to 3.5% by weight, and particularly about 0.05 to 3% by weight, relative to the nonwoven fabric. In the case where the proportion of the water-soluble thermoplastic resin is more than 5% by weight, the elution of the water-soluble thermoplastic resin increases in use, and flexibility of the nonwoven fabric is deteriorated. On the other hand, when the proportion of the water-soluble thermoplastic resin is too small, the nonwoven fabric is insufficient in water absorbency and as a result sometimes water absorbing performance of the fabric is deteriorated in use such as a wiper.

In the present invention, it is preferred that not less than 30% (e.g., 30 to 100%) of the surface of the nonwoven fabric (or the surface of the fiber constituting the nonwoven fabric) is coated with the water-soluble thermoplastic resin, and more preferably not less than 35% (e.g., 35 to 99%) and further preferably not less than 40% (e.g., 40 to 90%) thereof is coated with the water-soluble thermoplastic resin. Such a coverage may be, for example, not less than 45% (e.g., 45 to 80%), and preferably not less than 50% (e.g., 50 to 70%). In the case where the coverage with the water-soluble thermoplastic resin is too small, the water absorbency of the nonwoven fabric composed of ultra-fine continuous fibers is deteriorated.

The coverage of the surface of the nonwoven fabric (or the surface of the fiber constituting the nonwoven fabric) with the water-soluble thermoplastic resin may be analyzed by an X-ray photoelectron spectroscopy.

The water-soluble thermoplastic resin used in the nonwoven fabric of the present invention is not particularly limited to a specific one as far as the resin is a solid at room temperatures and can be dissolved and removed in a hydrophilic solvent (in particular water) at a temperature of not higher than 120° C. and be melt-spun. Examples of such a water-soluble thermoplastic resin include a cellulose-series resin (e.g., a $C_{1-3}$alkyl cellulose ether such as a methyl cellulose, a hydroxy$C_{1-3}$alkyl cellulose ether such as a hydroxymethyl cellulose, and a carboxy$C_{1-3}$alkyl cellulose ether such as a carboxymethyl cellulose); a polyalkylene glycol resin (e.g., a poly$C_{2-4}$alkylene oxide such as a polyethylene oxide and a polypropylene oxide); a polyvinyl-series resin (e.g., a polyvinyl pyrrolidone, a polyvinyl ether, a polyvinyl alcohol, and a polyvinyl acetal); an acrylic copolymer and an alkali metal salt thereof [e.g., a copolymer containing a unit composed of an acrylic monomer such as (meth)acrylic acid, a (meth)acrylic acid ester (e.g., hydroxyethyl(meth)acrylate), and (meth)acrylamide]; a vinyl-series copolymer or an alkali metal salt thereof [e.g., a copolymer of a vinyl-series monomer (such as isobutylene, styrene, ethylene, and vinyl ether) and an unsaturated carboxylic acid or an anhydride thereof (such as maleic anhydride)]; a resin having a solubilizing substituent, or an alkali metal salt thereof (e.g., a polyester, a polyamide and a polystyrene, which are obtained by introducing a substituent such as a sulfonic acid group, a carboxyl group and a hydroxyl group); and others. These water-soluble thermoplastic resins may be used singly or in combination.

Among these water-soluble thermoplastic resins, from the viewpoint of being excellent in melt-spinning stability and particularly excellent in water absorbency after immersion-treating in a water of 80° C. for 60 minutes, a polyvinyl alcohol-series resin such as a polyvinyl alcohol (PVA), particularly a water-soluble thermoplastic PVA, is preferred.

The PVA is not particularly limited to a specific one as far as the PVA can be melt-spun, and includes, for example, not only a PVA homopolymer but also a modified PVA into which a functional group is introduced by copolymerization, terminal or side-chain modification, and others. A typical and commercially available PVA cannot be melt spun because of having a melting temperature close to a thermal decomposition temperature thereof (in other words, the PVA has no thermoplasticity), and a variety of treatments is required in order to impart water solubility and thermoplasticity to the PVA.

The viscosity-average degree of polymerization (this term hereinafter is sometimes abbreviated polymerization degree) of the water-soluble thermoplastic PVA is, for example, about 200 to 800, preferably about 230 to 600, and more preferably about 250 to 500. In the water-soluble thermoplastic PVA used for an ordinary fiber, the fiber strength is higher as the polymerization degree is higher. Therefore, the PVA usually has a polymerization degree of not less than 1500 (for example, a polymerization degree of about 1700 or about 2100). Considering the fact, the polymerization degree of the water-soluble thermoplastic PVA used in the present invention (that is, a polymerization degree of 200 to 800) is extremely low. A too small polymerization degree cannot provide enough spinnability in melt spinning. As a result, a satisfactory nonwoven fabric composed of conjugate continuous fibers cannot be obtained in practical cases. On the other hand, in the case where the polymerization degree is too large, the melt viscosity is too high to discharge the polymer from a spinning nozzle. As a result, a satisfactory nonwoven fabric composed of conjugate continuous fibers cannot be obtained in practical cases.

The polymerization degree (P) of the water-soluble thermoplastic PVA is measured in accordance with JIS-K6726. For example, the polymerization degree of the water-soluble thermoplastic PVA is determined based on a limiting viscosity [η](dl/g) of the resin and the following formula:

$$P=([\eta]\times 10^3/8.29)^{(1/0.62)}$$

wherein the limiting viscosity is measured in a water of 30° C. after completely re-saponifying and purifying the water-soluble thermoplastic PVA.

The saponification degree of the water-soluble thermoplastic PVA used in the present invention is preferably in the range of 90 to 99.99 mol %, more preferably in the range of 92 to 99.9 mol %, and particularly preferably in the range of 94 to 99.8 mol %. In the case where the saponification degree is too small, the PVA lacks heat stability and sometimes prevents stable conjugated (or composite) melt spinning due to thermal decomposition or gelation. On the other hand, in the case where the saponification degree is too large, it is difficult to produce the water-soluble thermoplastic PVA stably.

The water-soluble thermoplastic PVA is obtained by saponifying a vinyl ester unit of a vinyl ester-series polymer. Examples of a vinyl compound monomer for forming the vinyl ester unit include vinyl formate, vinyl acetate, vinyl propionate, vinyl valerate, vinyl caprate, vinyl laurate, vinyl stearate, vinyl benzoate, vinyl pivalate and vinyl versatate. These vinyl compound monomers may be used singly or in combination. Among them, in view of high productivity of the water-soluble thermoplastic PVA, a vinyl ester of a lower aliphatic carboxylic acid, such as vinyl acetate and vinyl propionate, usually vinyl acetate is preferred.

The water-soluble thermoplastic PVA constituting the nonwoven fabric of the present invention may be a homopolymer or a modified PVA into which a copolymerizable unit is introduced. From the viewpoint of conjugated melt spinning property, water absorbency, physical property of fiber, and physical property of nonwoven fabric, it is preferred to use the modified PVA. The kind of the copolymerizable monomer in the modified PVA includes, for example, an α-olefin (e.g., an α-$C_{2-10}$olefin such as ethylene, propylene, 1-butene, isobutene and 1-hexene), (meth)acrylic acid and a salt thereof, a (meth)acrylic ester [e.g., a $C_{1-6}$alkyl(meth)acrylate such as methyl (meth)acrylate, ethyl(meth)acrylate, n-propyl (meth)acrylate and i-propyl(meth)acrylate], a (meth)acrylamide derivative [e.g., an N—$C_{1-6}$alkyl(meth)acrylamide such as (meth)acrylamide, N-methyl(meth)acrylamide and N-ethyl(meth)acrylamide], a vinyl ether (e.g., a $C_{1-10}$alkyl vinyl ether such as methyl vinyl ether, ethyl vinyl ether, n-propyl vinyl ether, i-propyl vinyl ether and n-butyl vinyl ether), a hydroxyl group-containing vinyl ether (e.g., a $C_{2-10}$alkanediol-vinyl ether such as ethylene glycol vinyl ether, 1,3-propanediol vinyl ether and 1,4-butanediol vinyl ether), an allyl ester (e.g., allyl acetate), an allyl ether (e.g., a $C_{1-10}$alkyl allyl ether such as propyl allyl ether, butyl allyl ether and hexyl allyl ether), a monomer having an oxyalkylene group (e.g., a vinyl-series monomer having a polyoxy$_{2-6}$alkylene group, such as a polyoxyethylene group, a polyoxypropylene group and a polyoxybutylene group), a vinylsilane (e.g., a vinyltri$C_{1-4}$alkoxysilane such as vinyltrimethoxysilane), a hydroxyl group-containing α-olefin or an esterified product thereof (e.g., a $C_{3-12}$alkenol or an esterified product thereof, such as isopropenyl acetate, 3-buten-1-ol, 4-penten-1-ol, 5-hexen-1-ol, 7-octen-1-ol, 9-decen-1-ol and 3-methyl-3-buten-1-ol), an N-vinylamide (e.g., N-vinylformamide, N-vinylacetamide and N-vinylpyrrolidone), an unsaturated carboxylic acid (e.g., fumaric acid, maleic acid, itaconic acid, citraconic acid, maleic anhydride, itaconic anhydride, and citraconic anhydride), a sulfonic acid group-containing monomer (e.g., ethylenesulfonic acid, allylsulfonic acid, methallylsulfonic acid, and 2-acrylamide-2-methylpropanesulfonic acid), and a cationic group-containing monomer [e.g., a vinyloxytetra$C_{1-10}$alkylammonium chloride such as vinyloxyethyltrimethylammonium chloride and vinyloxybutyltrimethylammonium chloride; a vinyloxytri$C_{1-10}$alkylamine such as vinyloxyethyldimethylamine and vinyloxymethyldiethylamine; an N-acrylamidetetra$C_{1-10}$alkylammonium chloride such as N-acrylamideethyltrimethylammonium chloride and N-acrylamidebutyltrimethylammonium chloride; an N-acrylamidedi$C_{1-10}$alkylamine such as N-acrylamidedimethylamine; a (meth)allyltri$C_{1-10}$alkylammonium chloride such as (meth)allyltrimethylammonium chloride; a di$C_{1-3}$alkylallylamine such as dimethylallylamine; and an allyl$C_{1-3}$alkylamine such as allylethylamine]. These monomers may be used singly or in combination. The content of these monomers is usually not more than 20 mol % in the case where the number of moles of all units constituting the modified PVA (or copolymer PVA) is taken as 100%. Further, in order to show advantages of copolymerization, it is preferred that the copolymerizable unit is not less than 0.01 mol % in the modified PVA.

In the modified PVA, among these monomers, in view of ready availability, the preferred monomer includes an α-$C_{2-6}$olefin such as ethylene, propylene, 1-butene, isobutene and 1-hexene; a $C_{1-6}$alkyl vinyl ether such as methyl vinyl ether, ethyl vinyl ether, n-propyl vinyl ether, i-propyl vinyl ether and n-butyl vinyl ether; a $C_{2-6}$alkanediol-vinyl ether such as ethylene glycol vinyl ether, 1,3-propanediol vinyl ether and 1,4-butanediol vinyl ether; an allyl ester such as allyl acetate; a $C_{1-6}$alkyl allyl ether such as propyl allyl ether, butyl allyl ether and hexyl allyl ether; an N-vinylamide such as N-vinylformamide, N-vinylacetamide and N-vinylpyrrolidone; a $C_{2-4}$oxyalkylene group-containing monomer such as a polyoxyethylene; and a $C_{3-10}$alkenol such as 3-buten-1-ol, 4-penten-1-ol, 5-hexen-1-ol, 7-octen-1-ol, 9-decen-1-ol and 3-methyl-3-buten-1-ol.

In particular, from the viewpoint of properties such as a copolymerization property, a conjugate spinning property and a physical property of fiber, an α-olefin having carbon atom(s) of not more than four, such as ethylene, propylene, 1-butene and isobutene, and a $C_{1-4}$alkyl vinyl ether such as methyl vinyl ether, ethyl vinyl ether, n-propyl vinyl ether, i-propyl vinyl ether and n-butyl vinyl ether are more preferred. The unit derived from the α-olefin having carbon atom(s) of not more than four and that derived from the $C_{1-4}$alkyl vinyl ether preferably exist in a proportion of 0.1 to 20 mol % in the water-soluble thermoplastic PVA, and more preferably exist in a proportion of 0.5 to 18 mol % therein.

Further, it is most preferred that the α-olefin comprises ethylene because the physical property of fiber is improved. In particular, it is preferred that the ethylene unit exists in a proportion of 3 to 20 mol % in the water-soluble thermoplastic PVA. It is more preferred to use a modified PVA into which the ethylene unit is introduced in a proportion of 5 to 18 mol % therein.

The water-soluble thermoplastic PVA used in the present invention may be obtained by a known method, such as a mass polymerization, a solution polymerization, a suspension polymerization and an emulsion polymerization. Among them, the mass polymerization or solution polymerization conducted in the absence or presence of a solvent (such as an alcohol) is usually adopted. For example, the alcohol used as a solvent in a solution polymerization of the water-soluble thermoplastic PVA includes a lower alcohol such as methyl alcohol, ethyl alcohol and propyl alcohol. An initiator used in the copolymerization includes a known initiator, e.g., an azo-series initiator such as α,α'-azobisisobutyronitrile and 2,2'-azobis(2,4-dimethyl-valeronitrile), and a peroxide-series initiator such as benzoyl peroxide and n-propyl peroxycarbonate. These initiators may be used singly or in combination. The polymerization temperature is not particularly limited to a specific one, and is suitably 0° C. to 200° C.

The content of an alkali metal ion in the water-soluble thermoplastic PVA used in the present invention is preferably 0.00001 to 0.05 parts by weight, more preferably 0.0001 to 0.03 parts by weight, and particularly preferably 0.0005 to 0.01 parts by weight, in terms of sodium ion relative to 100 parts by weight of the water-soluble thermoplastic PVA. For example, it is industrially difficult to produce a PVA in which the content of the alkali metal ion is less than 0.00001 parts by weight. Moreover, a too high content of the alkali metal ion significantly brings about polymer decomposition, gelation and fiber breakage in conjugated melt spinning, and therefore such a resin cannot be formed stably into a fiber in some cases. Incidentally, the alkali metal ion includes potassium ion, sodium ion, and others.

In the present invention, a method for allowing the water-soluble thermoplastic PVA to contain a specific amount of an alkali metal ion is not particularly limited to a specific one.

Regarding the water-soluble thermoplastic PVA, examples of a method for allowing the PVA to contain an alkali ion include a method which comprises obtaining a PVA by polymerization and then adding a compound containing an alkali metal ion to the PVA; and a method for controlling an alkali ion content in a PVA, which comprises allowing the PVA to contain an alkali metal ion by using an alkaline substance containing an alkali metal ion as a saponifying catalyst on saponification of a vinyl ester polymer in a solvent, and washing the obtained PVA with a washing solution. The latter method is more preferred. Incidentally, the content of the alkali metal ion may be determined by an atomic absorption method.

The alkaline substance used as the saponifying catalyst includes potassium hydroxide, sodium hydroxide, and others. The proportion (molar ratio) of the alkaline substance used as the saponifying catalyst is preferably 0.004 to 0.5 mol and particularly preferably 0.005 to 0.05 mol, relative to 1 mol of a vinyl acetate unit in a polyvinyl acetate. The saponifying catalyst may be added all at once at an early stage of the saponification reaction, or a part of the catalyst may be added at the early stage and the rest may be additionally added during the course of the saponification reaction.

The solvent for the saponification reaction includes an alcohol such as methanol, an ester such as methyl acetate, a sulfoxide such as dimethyl sulfoxide, an amide such as dimethylformamide, and others. These solvents may be used singly or in combination. Among them, it is preferred to use an alcohol such as methanol, more preferred to use methanol whose water content is controlled to about 0.001 to 1% by weight (preferably about 0.003 to 0.9% by weight, and more preferably 0.005 to 0.8% by weight). Examples of the washing solution include an alcohol such as methanol, a ketone such as acetone, an ester such as methyl acetate and ethyl acetate, a hydrocarbon such as hexane, and water. Among them, it is more preferred to use methanol, methyl acetate or water alone, or to use a mixture thereof.

The amount of the washing solution is set so that the content of the alkali metal ion is satisfied. The amount of the washing solution is usually preferably 300 to 10000 parts by weight and more preferably 500 to 5000 parts by weight, relative to 100 parts by weight of the water-soluble thermoplastic PVA. The washing temperature is preferably 5 to 80° C., and more preferably 20 to 70° C. The washing time is preferably 20 minutes to 100 hours, and more preferably one hour to 50 hours.

Moreover, in the range in which the objects or effects of the present invention are not deteriorated, to the water-soluble thermoplastic resin (e.g., the water-soluble thermoplastic PVA) can be added a plasticizer in order to adjust the melting point or the melt viscosity. As the plasticizer, conventionally known plasticizers may be used, and it is preferred to use diglycerin, an ester of a polyglycerin with an alkylmonocarboxylic acid, and a compound obtained by adding ethylene oxide and/or propylene oxide to a glycol. Among them, a compound obtained by adding about 1 to 30 mol of ethylene oxide relative to 1 mol of sorbitol is preferred.

The nonwoven fabric of the present invention comprises a water-insoluble thermoplastic resin. The water-insoluble thermoplastic resin used in the present invention is not particularly limited to a specific one as far as the resin is not dissolved in a hydrophilic solvent (particularly water) and can be melt-spun. For example, the water-insoluble thermoplastic resin includes a polyester-series resin [for example, an aromatic polyester (e.g., a polyalkylene arylate-series resin such as a polyethylene terephthalate, a polytrimethylene terephthalate, a polybutylene terephthalate and a polyhexamethylene terephthalate), an aliphatic polyester (e.g., an aliphatic polyester and a copolymer thereof, such as a polylactic acid, a polyethylene succinate, a polybutylene succinate, a polybutylene succinate adipate, a hydroxybutylate-hydroxyvalerate copolymer and a polycaprolactone), a polyamide-series resin (e.g., an aliphatic polyamide and a copolymer thereof, such as a nylon 6, a nylon 66, a nylon 610, a nylon 10, a nylon 12 and a nylon 6-12), a polyolefinic resin (e.g., a polyolefin and a copolymer thereof, such as a polypropylene, a polyethylene, an ethylene-propylene copolymer, a polybutene and a polymethylpentene), a water-insoluble modified polyvinyl alcohol containing an ethylene unit of more than 20 mol % to not more than 70 mol %, a thermoplastic elastomer (e.g., a polystyrenic, a polydiene-series, a polyolefinic, a polyester-series, a polyurethane-series, and a polyamide-series elastomer), a vinyl halide-series resin (e.g., a vinyl chloride-series resin, and a fluorine-containing resin), and others. These water-insoluble thermoplastic resins may be used singly or in combination.

Among these water-insoluble thermoplastic resins, from the viewpoint of easiness of conjugated spinning with the water-soluble thermoplastic resin (particularly the water-soluble thermoplastic PVA), the preferred resin includes a polyester-series resin (in particular a poly$C_{2-4}$alkylene arylate such as a polyethylene terephthalate, and an aliphatic polyester such as a polylactic acid), a polyamide-series resin (in particular an aliphatic polyamide-series resin such as a nylon 6 and a nylon 66), a polyolefinic resin (in particular a poly$C_{2-4}$olefinic resin such as a polypropylene and a polyethylene), and a modified polyvinyl alcohol containing an ethylene unit of 25 to 70 mol %. In particular, from the point that the water-soluble thermoplastic resin (e.g., the water-soluble thermoplastic PVA) tends to remain in the nonwoven fabric after extracting by a hydrophilic solvent, the water-insoluble thermoplastic resin may be a resin having a reactive group to the water-soluble thermoplastic resin. For example, in the case of using the water-soluble thermoplastic PVA as the water-soluble thermoplastic resin, the water-insoluble thermoplastic resin may be a polyester-series resin, a polyamide-series resin, a modified polyvinyl alcohol, and others.

The nonwoven fabric of the present invention may optionally contain an additive such as a stabilizer (e.g., a heat stabilizer such as a copper compound, an ultraviolet ray absorbing agent, a light stabilizer and an antioxidant), a fine particle, a coloring agent, an antistatic agent, a flame retardant, a plasticizer, a lubricant, and an agent for retarding crystallization rate, as far as the objects or effects of the present invention are not deteriorated. These additives may be used singly or in combination. These additives may be added in the polymerization reaction, or in following step(s). In particular, addition of an organic stabilizer (such as a hindered phenol), a copper halide compound (such as copper iodide) or alkali metal halide compound (such as potassium iodide) as a heat stabilizer is preferred because the melt retention stability on the occasion of making the resins into a fiber is improved.

Moreover, in the case where the fine particle, particularly an inactive fine particle such as an inorganic fine particle, is added to the water-insoluble thermoplastic resin and/or the water-soluble thermoplastic resin (in particular, the water-insoluble resin) before extractive removing the water-soluble thermoplastic resin, the spinning property or drawing property can be improved. The mean particle size of the fine particle is, for example, about 0.01 to 5 μm, preferably about 0.02 to 3 μm, and more preferably about 0.02 to 1 μm. The kind of the fine particle is not particularly limited to a specific one. For example, the fine particle includes an inorganic fine particle such as a silicon-containing compound (e.g., a silica), a metal oxide (e.g., titanium oxide), a metal carbonate (e.g., calcium carbonate) and a metal sulfate (e.g., barium sulfate). These fine particles may be used singly or in combination. Among these fine particles, silicon oxide or silicon dioxide (such as a silica), in particular a silica having a mean particle size of about 0.02 to 1 μm, is preferred.

Next, the production process of the nonwoven fabric of the present invention is described. The nonwoven fabric of the present invention may be produced by dissolving (extracting) and removing a water-soluble thermoplastic resin from a nonwoven fabric formed from a conjugate continuous fiber comprised of the water-soluble thermoplastic resin and a water-insoluble thermoplastic resin, with a hydrophilic solvent.

The nonwoven fabric composed of conjugate continuous fibers which comprises the water-soluble thermoplastic resin and the water-insoluble thermoplastic resin may be produced efficiently by a process in which melt spinning is directly connected to forming of nonwoven fabric, so-called a process for producing a spunbonded nonwoven fabric.

As a production process of a spunbonded nonwoven fabric, for example, there may be mentioned the following method. First, a water-soluble thermoplastic resin and a water-insoluble thermoplastic resin are melt-kneaded independently with different extruders, these molten polymers are continuously guided to a spinning head, respectively, and are made to one, and then the converged flow is discharged from a spinning nozzle orifice with weighing the amount of the converged flow. Next, the discharged thread is cooled by a cooling apparatus, then drawn and made thin by a high-speed air flow using an aspirator (such as an air jet nozzle) so that the object fineness is ensured. Thereafter, a nonwoven fabric web is formed by depositing the thread on a traveling collecting surface with opening. Finally the web is partially thermocompressed and then wound to give a nonwoven fabric composed of conjugate continuous fibers.

The cross-sectional form of the conjugate continuous fiber constituting the nonwoven fabric composed of conjugate continuous fibers (a form of the cross section perpendicular to the long direction of the fiber) is not particularly limited to a specific one, and may be a modified (or irregular) cross-section [e.g., a hollow form, a flat (or shallow) form, an elliptical form, a polygonal form, a multi-leaves form from tri-leaves to 14-leaves, a T-shaped form, a H-shaped form, a V-shaped form, and a dog bone form (I-shaped form)]. The cross section is usually in the form of a round cross-section. In the present invention, the cross section has a conjugate structure comprising a phase composed of the water-insoluble thermoplastic resin and a phase composed of the water-soluble thermoplastic resin, in order to form an ultra-fine continuous fiber.

More specifically, it is necessary that the conjugate continuous fiber has a structure in which the water-soluble thermoplastic resin and the water-insoluble thermoplastic resin are separable from each other in the axial (or long) direction of the conjugate continuous fiber, that is, a structure in which the water-soluble thermoplastic is dissolvable and removable continuously in the axial direction to give an ultra-fine continuous fiber formed of the remaining water-insoluble thermoplastic resin. Therefore, the conjugate continuous fiber comprises a water-soluble resin phase extending toward the axial direction and a plurality of the water-insoluble resin phase extending toward the coaxial direction to the water-soluble resin phase. The conjugate continuous fiber has a conjugate structure, in the cross section, comprising an ultra-fine fiber component composed of the water-insoluble thermoplastic resin, and a water-soluble thermoplastic resin for separating or splitting the component into one or a plurality of isolated section(s). The form (or shape) of the conjugate cross section in the conjugate continuous fiber includes, with considering separability in the conjugate fiber or uniformity in an ultra-fine continuous fiber obtained from the conjugate fiber, an orange cross-sectional or a fan-shaped form (that is, a form in which a phase composed of a water-insoluble thermoplastic resin and a phase composed of a water-soluble thermoplastic resin are alternately arranged in a radial pattern from the center of the cross section), a laminate-shaped form (that is, a form in which a phase composed of a water-insoluble thermoplastic resin and a phase composed of a water-soluble thermoplastic resin are alternately arranged in striped pattern), and an islands-in-the-sea-shaped form (that is, a form comprising a sea component composed of a water-soluble thermoplastic resin and an island component composed of a water-insoluble thermoplastic resin). These forms may be combined.

The ultra-fine fiber-forming component constituting the conjugate continuous fiber (that is the water-insoluble thermoplastic resin component) is preferably separated (or divided) by the water-soluble thermoplastic resin into, for example, about 2 to 800 pieces, preferably about 3 to 500 pieces, and more preferably about 3 to 200 pieces. In the case where the conjugate cross-sectional form (or shape) of the conjugate continuous fiber is the orange cross-sectional form, the fan-shaped form or the laminate-shaped form, it is preferred that the ultra-fine fiber-forming component constituting the conjugate continuous fiber is separated into about 2 to 50 pieces (preferably about 2 to 20 pieces, and more preferably about 3 to 15 pieces) by the water-soluble thermoplastic resin in view of productivity. Moreover, when the conjugate cross section is the islands-in-the-sea-shaped form, it is preferred that the number of the island component being the ultra-fine fiber-forming component is in 2 to 800 pieces in view of productivity, and more preferably in about 5 to 500 pieces (particularly 10 to 200 pieces). In particular, a conjugate continuous fiber whose conjugate cross-section has a modified cross-sectional form such as the orange cross-sectional form, the fan-shaped form, or the laminate-shaped form and in which the ultra-fine fiber-forming component is separated into 6 to 15 pieces is advantageous in the point of showing an improved water absorbency with a high durability. Such a conjugate continuous fiber is therefore particularly suitable for the present invention.

In the case of using the nonwoven fabric for a wiper, it is preferred to use a fiber having the orange cross-sectional form or the fan-shaped form arranged in a radial pattern, or the laminate-shaped form arranged in a striped pattern because a fiber having a squarish (or angular) cross section is excellent in wiping property. On the other hand, in the case of using for a battery separator or a filter, the islands-in-the-sea-shaped form, from which a fine fiber is easily obtainable, is preferred because the fineness of the fiber is important to the use for such an application.

In the nonwoven fabric composed of conjugate continuous fibers used in the present invention, the proportion (weight ratio) of the water-insoluble thermoplastic resin relative to the water-soluble thermoplastic resin is suitably selected for any purpose and is not particularly limited to a specific one. The ratio [water-insoluble thermoplastic resin/the water-soluble thermoplastic resin] may be selected in the range of about 5/95 to 92/8, and is, for example, about 10/90 to 90/10, preferably about 20/80 to 90/10, and more preferably about 30/70 to 90/10 (particularly about 50/50 to 90/10).

In the present invention, it is necessary to suitably set condition(s) for forming fibers constituting the nonwoven fabric composed of conjugate continuous fibers in accordance with combination of polymers, or the form (or shape) of the conjugate cross section. In the main, it is desired that the condition for forming fibers is determined, with paying attention of the points mentioned below.

The spinneret temperature is, for example, about (Mp+10)° C. to (Mp+80)° C., preferably about (Mp+15)° C. to (Mp+70)° C., and more preferably about (Mp+20)° C. to (Mp+60)° C., when a melting point of a polymer having highest melting point out of polymers constituting the conjugate continuous fiber is taken as Mp. The shear rate ($\gamma$) in fiber-spinning is, for example, about 500 to 25000 $sec^{-1}$ preferably about 1000 to 20000 $sec^{-1}$, and more preferably about 1500 to 10000 $sec^{-1}$. The draft (V) in fiber-spinning is, for example, about 50 to 2000, and preferably about 100 to 1500. Moreover, in view of combination of polymers to be conjugated-spun, it is preferred to use the combination of polymers with close melt viscosities measured at a spinneret temperature and at a shear rate on nozzle passage in a spinning process. For example, from the aspect of spinning stability, it is preferred to use composition of polymers for conjugated spinning, where the melt viscosity difference between the polymers measured at a spinneret temperature in a melt spinning process and at a shear rate of 1000 $sec^{-1}$ is within 2000 poise (preferably within 1500 poise).

The melting point Tm of a polymer in the present invention means a peak temperature of a main endoergic peak observed by a differential scanning calorimeter (DSC: e.g., trade name "TA3000" manufactured by Mettler-Toledo K.K.) The shear rate ($\gamma$) is determined as $\gamma=4Q/\pi r^3$, wherein "r" (cm) represents a nozzle radius and "Q" ($cm^3$/sec) represents a polymer discharge rate per one orifice. Moreover, the draft "V" is calculated as $V=A\cdot\pi r^2/Q$, wherein "A" (m/min.) represents a drawing rate.

In the production of the conjugate fiber, when the spinneret temperature is too low, the melt viscosity of the polymer is too high and thus spinnability and thinness by high-speed air flow deteriorates. Moreover, the water-soluble thermoplastic resin having a too high viscosity is thermally decomposed easily and therefore the fiber spinning cannot be carried out stably. Further, when the shear rate is too low, the fiber is easy to be broken. When the shear rate is too high, the back pressure of the nozzle increases and the spinnability is deteriorated. Furthermore, in the case where the draft is too low, it is difficult to spin the fiber stably because of increase of uneven fineness. When the draft is too high, the fiber is easy to be broken.

In drawing a discharged thread and making the thread thin by using an aspirator such as an air jet nozzle in the present invention, it is preferred to make the thread thin by drawing the thread at a rate corresponding to a thread-drawing rate of about 1000 to 6000 m/min. (preferably about 2000 to 5000 m/min.) by a high-speed air flow. The drawing condition of the thread by the evacuating unit is suitably selected depending on a melt viscosity of a molten polymer discharged from a spinning nozzle orifice, a discharge rate, a spinning nozzle temperature, a cooling condition, and others. A too slow drawing rate sometimes induces fusion between adjacent fibers due to delay of cooling and solidification of the discharged thread. Further, when the drawing rate is too slow, since the orientation and crystallization of the thread does not proceed, the obtained nonwoven fabric composed of conjugate fibers is roughness and low in mechanical strength. Therefore, a too slow drawing rate is not preferred. On the other hand, when the drawing rate is too high, it is impossible to make the discharged thread thin with drawing and the thread is broken. As a result, a nonwoven fabric composed of conjugate continuous fibers cannot be stably produced.

Further, in order to stably produce the nonwoven fabric composed of conjugate continuous fibers, it is preferred that the distance between the spinning nozzle orifice and the aspirator (such as an air jet nozzle) is about 30 to 200 cm (in particular about 40 to 150 cm). Such a distance depends on the kind of polymers to be used, the formulation, and the above-mentioned spinning condition. In the case where the distance is too short, fusion between the adjacent fibers sometimes occurs due to delay of cooling and solidification of the discharged thread. Further, since the orientation and crystallization of the thread does not proceed, the obtained nonwoven fabric composed of conjugate fibers has roughness and a low mechanical strength. On the other hand, when the distance is too long, the cooling and solidification of the thread proceeds too fast to make discharged thread thin with drawing. As a result, the fiber is broken, and a nonwoven fabric composed of conjugate continuous fibers cannot be stably produced.

The conjugate continuous fiber thinned by using the aspirator such as an air jet nozzle is almost uniformly dispersed and collected on the surface of a collecting sheet so that a web is formed. It is preferred that the distance between the evacuating unit and the collecting surface is about 30 to 200 cm (particularly about 40 to 150 cm) from the viewing of productivity and a physical property of fiber in the obtained nonwoven fabric. Moreover, the fabric weight of the web is preferably in the range of about 5 to 500 g/$m^2$ (preferably about 10 to 400 g/$m^2$, and more preferably about 50 to 300 g/$m^2$) in view of productivity of the nonwoven fabric and workability (or processability or improvement). Further, the yarn fineness of the conjugate continuous fiber evacuated and thinned for forming the web is preferably about 0.2 to 8 dtex (preferably about 0.5 to 7 dtex, and more preferably about 1 to 6 dtex) to the extent of productivity.

In the present invention, by extractive removing the water-soluble thermoplastic resin from the nonwoven fabric composed of conjugate continuous fibers with a hydrophilic solvent, the water-insoluble thermoplastic resin can be made ultra-fine. The hydrophilic solvent includes water, in addition an alcohol (e.g., methanol, ethanol, isopropanol and butanol), a ketone (e.g., acetone), an ether (e.g., dioxane and tetrahydrofuran), a cellosolve (e.g., methyl cellosolve, ethyl cellosolve and butyl cellosolve), a carbitol (carbitol, diethylene glycol dimethyl ether and diethylene glycol methyl ethyl ether), and others. These hydrophilic solvents may be used singly or in combination. Among these hydrophilic solvents, the preferred solvent includes water, a $C_{1-3}$alcohol such as ethanol, a ketone such as acetone, a mixed solvent of water and other hydrophilic solvent(s), and others. As the solvent, water is usually employed.

The method for extracting the water-soluble thermoplastic resin from the nonwoven fabric composed of conjugate continuous fibers with the hydrophilic solvent is not particularly limited to a specific one, and may be selected from conventional methods, e.g., a method using a dyeing machine (such as circular, beam, jigger and winch) or a hot water-treatment apparatus (such as a vibrowasher and a relaxer), and a method jetting a pressurized water. The method jetting (or spraying) a pressurized water is quite useful as a method from the point that separated (or split) ultra-fine continuous fibers are entangled strongly with each other and further the nonwoven fabric improves water absorbency due to capillary phenomenon. However, it is often difficult to reduce the quantity of the water-soluble thermoplastic resin adhered to the water-insoluble thermoplastic resin a range defined in the present invention by only jetting a pressurized water. Therefore, it is preferred to use a method which comprises adjusting the quantity of the water-soluble thermoplastic resin to the water-insoluble thermoplastic resin to the defined range of the present invention by stirring the nonwoven fabric in a bath of the hydrophilic solvent after treating with the pressurized water. In the case of using water as the hydrophilic solvent, the extractant may be a neutral solution, or may be an alkali solution, an acidic solution or an aqueous solution added a detergent and others thereto.

What is particularly important in the present invention is that the extractive removing of the water-soluble thermoplastic resin with the hydrophilic solvent should be conducted so that part of the water-soluble thermoplastic resin remains within the nonwoven fabric. To this end, it is preferred to decide the treating condition(s) in advance so as to ensure liquid absorbency (water absorbency) defined in the present invention, where the treating condition(s) is determined by variously modifying the amount of the hydrophilic solvent to be used for the removing treatment, the treating manner, the treating time, the treating temperature, and others.

In concrete terms, the preferred method for extractive removing the water-soluble thermoplastic resin with the hydrophilic solvent in the present invention includes a method which comprises stirring the nonwoven fabric composed of conjugate continuous fibers in a bath of the hydrophilic solvent to dissolve and remove the water-soluble thermoplastic resin. The proportion of the hydrophilic solvent is about 100 to 2000 parts by weight, preferably about 200 to 1000 parts by weight, and more preferably about 200 to 500 parts by weight relative to 1 part by weight of the nonwoven fabric composed of conjugate continuous fibers. In the case where the amount of the hydrophilic solvent is too small, it is insufficient to dissolve and remove the water-soluble thermoplastic resin, and the object nonwoven fabric composed of ultra-fine continuous fibers cannot be often obtained. Moreover, when the amount of the hydrophilic solvent is too large, the conjugate continuous fiber cannot be efficiently separated to the ultra-fine continuous fibers. Incidentally, in the case where the extractive removing of the water-soluble thermoplastic resin is insufficient, another extractive removing of the water-soluble thermoplastic resin may be conducted using a hydrophilic solvent containing no water-soluble thermoplastic resin in a water bath.

The extractive treatment temperature may be suitably adjusted depending on the purpose and the kind of the solvent. For example, in the case of extracting with a hot water, the treatment is conducted preferably at 40 to 120° C., more preferably at 60 to 110° C., and particularly preferably at 80 to 100° C. When the treatment temperature is too low, the water-soluble thermoplastic resin is not extracted sufficiently and induces deterioration of productivity. Moreover, a too high treatment temperature makes the extracting time of the water-soluble thermoplastic resin extremely short, and it is sometimes difficult to stably produce the nonwoven fabric having a required proportion of the water-soluble thermoplastic resin. Once the water-soluble thermoplastic is extractive removed from the nonwoven fabric completely, it is difficult to ensure water absorbency with a high durability as defined in the present invention even though the water-soluble thermoplastic resin is added to the nonwoven fabric by applying a solution containing the water-soluble thermoplastic resin, or other means.

The extractive treatment time may be also suitably adjusted depending on the object, apparatus to be used, and treatment temperature. Considering production efficiency and stability, and quality and performance of the obtained nonwoven fabric composed of ultra-fine continuous fibers, in the case of a batch treatment the treatment time is preferably about 10 to 200 minutes (particularly about 10 to 150 minutes) in total. In the case of a continuous treatment the treatment time is preferably about 1 to 50 minutes (particularly about 1 to 20 minutes).

Regarding the extractive treatment (in particular an extractive treatment with water), in order to improve filamentary separability from the conjugate continuous fiber into the ultra-fine continuous fiber, it is effective that the extractive treatment is started from a water temperature not higher than 50° C. (e.g., about 10 to 50° C.), preferably from around room temperature and the water temperature is increased gradually up to a given temperature (e.g., up to about 80 to 120° C., preferably up to about 80 to 110° C.), and the extractive treatment is carried out in the temperature range for about 5 minutes to 10 hours (particularly for about 10 minutes to 5 hours). Such a treatment is particularly effective when the conjugate fiber has a cross-sectional form such as the orange cross-sectional form, the fan-shaped form, the laminate-shaped form and the islands-in-the-sea-shaped form.

The rate of increase of temperature on heating is preferably about 0.2 to 30° C./minute (particularly about 1 to 20° C./minute). By applying such a condition, the water-soluble thermoplastic resin component is constricted on dissolution. As a result, the ultra-fine continuous fiber composed of the water-insoluble thermoplastic resin as a residual component has minute crimp and separability of the ultra-fine continuous fiber is improved, and the water absorbency of the obtained nonwoven fabric composed of ultra-fine continuous fibers is more improved. The preferred percentage of contraction is about 0.1 to 10% (particularly about 0.3 to 7%). Regarding the degree of minute crimp, the percentage of crimp is, for example, about 1 to 50%, preferably about 1 to 40%, and more preferably about 1 to 30%. A known nonwoven fabric composed of continuous fibers is usually obtained by drawing a melt-spun fiber and just cumulating (or stacking) the drawn fiber on a collecting surface, and therefore the fiber constituting the nonwoven fabric has no crimp. On the other hand, the fiber constituting the nonwoven fabric of the present invention has crimp due to contraction of the water-soluble thermoplastic resin (particularly the water-soluble thermoplastic PVA) in the middle of manufacture. This brings about positive effects on an adsorption effect, an effect as a filter, an effect as a separator, and others for applications such as a wiper, a filter, a battery separator, and the like.

Other than such a method, as a method for improving separability of the conjugate continuous fiber, various methods, such as a separating method by jetting a pressurized water and a separating method by passing through between pressure rolls, is applicable, and such a method is carried out in combination with a method for extractive removing the water-soluble thermoplastic resin.

The water content of the nonwoven fabric of the present invention is, for example, not less than 0.001% by weight (e.g., about 0.001 to 5% by weight), preferably not less than 0.01% by weight (e.g., about 0.01 to 1% by weight) and more preferably not less than 0.1% by weight (e.g., about 0.1 to 0.5% by weight), relative to the nonwoven fabric. In the case where the water content is too low, the water absorbency of the nonwoven fabric is insufficient and therefore it is sometimes difficult to use the fabric for applications such as a wiper.

In the present invention, to maintain the above water content, a step for applying water or moisture to the nonwoven fabric composed of ultra-fine continuous fibers may be additionally set up as the step after drying or pressurizing treatment with a thermal calender roll. The method for applying water is not particularly limited to a specific one and may be, for example, suitably selected from a method of spraying water on the surface of the nonwoven fabric, a method of adjusting humidity of the nonwoven fabric in a constant temperature and humidity box, a method of immersing the nonwoven fabric for a short time in a water bath and others.

In order to satisfy the water absorbency defined in the present invention, the drying temperature after extractive treating the water-soluble thermoplastic resin is, for example, not higher than 120° C. (e.g., about 30 to 120° C.), preferably not higher than 100° C. (e.g., about 40 to 100° C.), and more preferably not higher than 90° C. (e.g., about 50 to 90° C.). A too high drying temperature reduces the water content of the nonwoven fabric due to progress of crystallization of the residual water-soluble thermoplastic resin (particularly the water-soluble thermoplastic PVA), and as a result the water absorbing performance of the nonwoven fabric is decreased. Needless to say, the drying step may be carried out at a room temperature.

The drying time may be also suitably adjusted in accordance with the object, apparatus to be used, and drying temperature. Considering production efficiency, stability, and quality and performance of the obtained nonwoven fabric composed of ultra-fine continuous fibers, the drying time is within 24 hours (e.g., about one minute to 24 hours) in the case of conducting a batch treatment, and within one hour (e.g., about one minute to one hour) and in the case of a continuous treatment.

The nonwoven fabric in which most of the water-soluble thermoplastic resin has been removed is substantially formed from ultra-fine continuous fiber bundles, which is an aggregate of the ultra-fine continuous fibers. As a result, the nonwoven fabric of the present invention is composed of bundles, and accordingly hardly generates fluff (or nap), easily remains therein a given amount of the water-soluble thermoplastic resin, compared with a conventional nonwoven fabric composed of ultra-fine fibers independent from each other. Therefore, the nonwoven fabric of the present invention is improved in water absorbency and is further improved in shape stability of the nonwoven fabric.

Incidentally, it is possible to ravel the bundle by means of a entangling method such as hydroentanglement to make each of the ultra-fine continuous fibers independent. Such a method is effective in the case of imparting softness (or flexibility) to the nonwoven fabric, and the softness (or flexibility) is suitably adjustable by changing the degree of entanglement.

Further, in the present invention, when the residual amount of the water-soluble thermoplastic resin is large, e.g., when the water-soluble thermoplastic resin exists at the ratio of not less than 1% by weight relative to the nonwoven fabric, the fibers constituting the nonwoven fabric are fixed with each other through the residual water-soluble thermoplastic resin. Therefore the residual large amount of the water-soluble thermoplastic resin is also preferred in view of maintaining the shape of the nonwoven fabric.

In the present invention, the fabric weight of the nonwoven fabric is preferably in the range of 5 to 500 g/m$^2$ (preferably 10 to 400 g/m$^2$, and more preferably 50 to 300 g/m$^2$) in terms of productivity of the nonwoven fabric and workability (or processability) of the obtained nonwoven fabric.

Among the water-soluble thermoplastic resins used in the present invention, for example, the water-soluble thermoplastic PVA is biodegradable, and is decomposed into water and carbon dioxide by treating with activated sludge or burying in soil. For treating the waste fluid after dissolving and removing the PVA, the activated sludge process is preferred. In the case of treating continuously the aqueous solution containing a PVA with an activated sluge, the PVA is decomposed in two days to one month. Moreover, since the PVA used in the present invention has low combustion heat and small load to an incinerator, the PVA may be incinerated after drying the waste fluid.

In the present invention, thus obtained nonwoven fabric (or nonwoven web) with ultra-fine continuous fibers can be subjected to a fusion bond method for keeping the shape by partial thermocompression. More specifically, to try to stabilize the shape of the nonwoven fabric, the obtained web is passed between a heated uneven-patterned metal roll (embossed roll) and a heated smooth roll to fusion bond the continuous fibers thereof together by partial thermocompression. In the thermocompression treatment, conditions such as the temperature of the heated roll, the pressure in thermocompression, the processing speed and the pattern of the embossed roll may be suitably selected for any purpose. Moreover, it is not particularly limited regarding step or time the thermocompression is carried out, and the thermocompression may be accordingly carried out if necessary. For example, the thermocompression treatment may be conducted before extracting the water-soluble thermoplastic resin with the hydrophilic solvent, or after separating the conjugate fiber into ultra-fine fibers by jetting a pressurized water.

The area ratio of the part thermocompressed with such an embossed pattern is about 1 to 40% (preferably about 5 to 30%, and more preferably about 10 to 25%) of the surface area of the nonwoven fabric, in view of shape stability, flexibility, and water absorbency.

Further, the nonwoven fabric of the present invention may be subjected to after processing treatment, depending on the purpose, such as an electrizing treatment by electret processing, and a hydrophilic treatment by a plasma discharge treatment or a corona discharge treatment.

Moreover, the nonwoven fabric composed of ultra-fine continuous fibers obtained in the present invention may be not only used alone but also used as a laminate by laminating on other nonwoven fabric [e.g., a nonwoven fabric composed of continuous fibers, and a nonwoven fabric composed of short-cut (or staple) fibers], a textile fabric [e.g., a woven fabric (or weaving) and a knitted fabric (or knitting)], and others. As usage, practical functions may be imparted to the nonwoven fabric by laminating on other nonwoven fabric or textile fabric. For example, lamination of a meltblown nonwoven fabric on one side of the nonwoven fabric of the present invention provides a laminated nonwoven fabric composed of ultra-fine fibers, which is suitable for filter application described below.

The nonwoven fabric of the present invention can be suitably used as wipers, e.g., a wiper for wiping out an aqueous liquid and an aqueous liquid-soaked wiper, because of being excellent in flexibility and water absorbency.

Moreover, since the nonwoven fabric of the present invention has a large surface area and an excellent filtration property, the nonwoven fabric can be used as a filter material or a filter substrate. In this case, the nonwoven fabric can be suitable used as not only a filter for gas, but also a filter for liquid, which removes a contaminant from an aqueous liquid containing the contaminant, by making the most of the excellent water absorbency. In the case of utilizing for the filter material or the filter substrate, the air permeability is usually not more than 200 ml/cm$^2$/sec (e.g., about 1 to 200 ml/cm$^2$/sec), preferably not more than 160 ml/cm$^2$/sec (e.g., about 5 to 160 ml/cm$^2$/sec), and more preferably not more than 120 ml/cm$^2$/sec (e.g., about 10 to 120 ml/cm$^2$/sec). When the air permeability is too large, enough filter functions cannot be accomplished in some cases. Though the lower limit of the air permeability is not particularly limited to a specific one, to achieve an object as a filter the lower limit is 1 ml/cm$^2$/sec. Such an air permeability is determined in accordance with the method using Frazier permeometer of JIS-L1906 "Test methods for non-woven fabrics made of filament yarn".

Further, the nonwoven fabric of the present invention can be also used as a battery separator. In particular, in the case of using as the battery separator, in the present invention, to respond the separator to a battery having a larger capacity, it is preferred to reduce the thickness of the nonwoven fabric composed of ultra-fine continuous fibers down to not more than 250 μm (e.g., about 10 to 250 μm) by pressure-treating with the use of a thermal calender roll or others. In this case, the temperature of the pressure treatment is, for example, about 40 to 120° C., preferably about 50 to 100° C., and more preferably about 60 to 90° C. A too low treatment temperature sometimes reduces in the thickness of the nonwoven fabric insufficiently with ultra-fine continuous fibers. Moreover, when the treatment temperature is too high, the water absorbing performance as a battery separator is sometimes deteriorated due to crystallization progress of the remaining water-soluble thermoplastic resin.

Moreover, the linear load in the pressure treatment is preferably about 20 to 200 kgf/cm (196 to 1960 N/cm), and more preferably about 50 to 150 kgf/cm (490 to 1470 N/cm). In the case where the linear load is too low, reduction of the thickness of the nonwoven fabric composed of ultra-fine continuous fibers is sometimes insufficient and uneven. Further, a too high linear load sometimes seriously deteriorates water absorbency of the separator surface.

Thus obtained nonwoven fabric composed of ultra-fine continuous fibers shows an excellent water absorbing performance, and can serve as a battery separator by itself. Further in order to improve the water absorbency, the nonwoven fabric may be subjected to a variety of hydrophilic treatments, if necessary. The method of the hydrophilic treatment includes, for example, a sulfonation treatment, a discharge treatment such as a corona discharge and a plasma discharge, a graft-polymerization treatment, a fluorine gas treatment, and others. In the case of using the nonwoven fabric of the present invention as a battery separator, the water-insoluble thermoplastic resin constituting the ultra-fine continuous fiber preferably includes a polyamide-series resin, a polyester-series resin, a polyolefinic resin, and others. For example, the fiber may be composed of a polypropylene-series resin such as a polypropylene because of having alkali resistance. As a separator for alkaline secondary battery such as a nickel-cadmium battery and a nickel-hydrogen battery, a nonwoven fabric made from a polypropylene imparted hydrophilicity thereto by a sulfonation treatment has been used in the past. However, because of being excellent in water absorbency (hydrophilicity), that is, alkali solution absorbency, the nonwoven fabric of the present invention has water absorbency equivalent to the conventional separator without a sulfonation treatment for hydrophilicity.

The battery separator obtained from the nonwoven fabric of the present invention is excellent in alkali resistance, liquid retention, oxidation resistance and acid resistance, and can be extensively used for an alkaline battery, a lead storage battery, an air battery, and others. Among them, the battery separator is widely used for an alkaline battery (or alkaline cell) composed of a metal oxide or a metal hydroxide for the cathode, and cadmium, zinc, iron, a hydroxide thereof or a hydrogen storage alloy thereof for the anode. In particular, the nonwoven of the present invention may be preferably applicable for an alkaline secondary battery that can be charged and recharged time after time (e.g., a nickel-cadmium battery and a nickel-hydrogen battery).

Further, the nonwoven fabric of the present invention can be suitably used for a capacitor separator because of comprising ultra-fine fibers and being excellent in water absorption and retention. The capacitor means a system having a storage function. More specifically, the capacitor is a condenser having a dielectric substance or an electric double layer, in which the dielectric substance or the electric double layer is situated between two electrodes facing each other.

The dielectric substance contained in the capacitor includes, for example, an aluminum electrolytic condenser, a tantalum electrolytic condenser, and others.

On the other hand, a capacitor having an electric double layer between two electrodes forms therein the electric double layer on the boundary face between each electrode and an electrolysis solution, and is referred to as a electric double-layer capacitor. As each electrode of the electric double-layer capacitor, a polarizable electrode composed of a conductor having a large surface area (e.g., an activated carbon) or the like is used. Incidentally, the electrodes may be a pair of polarizable electrodes, or combination of a polarizable electrode and a non-polarizable electrode. As the electrolysis solution for the capacitor, an aqueous or organic electrolysis solution (e.g., a propylene carbonate solution, and an acetonitrile solution) is usually employed.

Also in the case of using as the capacitor separator, it is preferred that the thickness of the separator is set to not more than 250 μm (e.g., about 10 to 250 μm) in order to increase the storage capacity of the capacitor by reducing the volume proportion of the separator in the capacitor and increasing the proportion of the dielectric substance or the electric double layer in the capacitor. The same method as the method for reducing thickness in the battery separator may be used in order to reduce the thickness of the capacitor separator.

Furthermore, the nonwoven fabric of the present invention can be used for a variety of applications by making the most of the excellent flexibility, water absorbency and filtration property. Examples of the applications include industrial materials such as an electronics use such as a separator for insulating material, an oil absorbent material, a leather foundation cloth, a reinforcing material for cement, a reinforcing material for rubber, and various tape substances (or base materials); medical or sanitary materials such as a disposable diaper, a gauze, a bandage, a gown for medical use, and a surgical tape; everyday commodities such as a material to be printed, a package or bag material, and a storage material; clothing materials; interior materials such as a heat insulating material and an acoustic material; building materials; agricultural or horticultural materials; civil engineering materials such as a soil stabilizer, a strainer material, a quicksand inhibiting material and a reinforcing material; and bag or shoes materials.

According to the present invention, a nonwoven fabric composed of ultra-fine continuous fibers, which has a high flexibility, has a high mechanical strength even when the fiber diameter is small, and has an excellent water absorbency, is obtained. Moreover, the nonwoven fabric has a water absorbency with a high durability, for example, can maintain a high water absorbency for a long period. Further, according to the present invention, a nonwoven fabric composed of ultra-fine continuous fibers, which has a high flexibility and a high liquid absorbency, is obtained by utilizing a spunbonded process. Accordingly, such a nonwoven fabric is suitable for various applications such as a wiper, a filter material, and a battery or capacitor separator.

EXAMPLES

The following examples are intended to describe this invention in further detail and should by no means be interpreted as defining the scope of the invention. The details of a plasticizer and thermoplastic polymers (water-insoluble thermoplastic resins) used in the examples are shown below. Further, in the examples, each of physical properties was determined as follows. Incidentally, "part(s)" and "%" in the examples indicate the proportion by weight unless otherwise stated.

[Plasticizer and Thermoplastic Polymer]

Plasticizer: a compound in which 2 mol of ethylene oxide on the average is added to 1 mol of sorbitol PET: a polyethylene terephthalate (intrinsic viscosity: 0.7, melting point: 255° C.)

PP: a polypropylene (melt index (MI) measured at a temperature of 230° C. under a load of 21.18N: 35)

Ny: a 6-nylon (intrinsic viscosity: 2.6, melting point: 222° C.)

EVOH-1: an ethylene-vinyl alcohol copolymer (ethylene: 24 mol %, MI measured at a temperature of 210° C. under a load of 21.18N: 45)

EVOH-2: an ethylene-vinyl alcohol copolymer (ethylene: 32 mol %, MI measured at a temperature of 190° C. under a load of 21.18N: 35)

[Analysis Method of PVA]

The analysis method of the PVA was conducted in accordance with JIS-K6726 except as otherwise noted.

The modifying amount was determined based on measurement of a modified polyvinyl ester or modified PVA by a 500 MHz $^{1}$H-NMR apparatus (manufactured by JEOL, "GX-500").

The content of the alkali metal ion was determined by an atomic absorption method.

[Melting Point]

The melting point of the PVA was measured using a DSC (manufactured by Mettler-Toledo K.K., "TA3000") as follows. The PVA was heated to 250° C. at a heating rate of 10° C./min. under nitrogen atmosphere and then cooled to a room temperature, and again heated to 250° C. at a heating rate of 10° C./min. The temperature of top of the endoergic peak was determined as a melting point of the PVA.

[Spinning State]

The state of the melt spinning was observed visually and evaluated on the basis of the following criteria.

"A": extremely good

"B": good

"C": slightly faulty

"D": bad

[State of Nonwoven Fabric]

The obtained nonwoven fabric was observed visually and with the hand, and evaluated on the basis of the following criteria.

"A": uniform and extremely good

"B": almost uniform and good

"C": slightly faulty

"D": bad

[Proportion of PVA Relative to Nonwoven Fabric]

A nonwoven fabric sample of 30 centimeters square was immersed in 2000 ml of a water in an autoclave, and heat-treated at 120° C. for one hour. After the treatment, the nonwoven fabric was removed from the hot water and wrung lightly. The solution obtained by the above extracting was changed to fresh water, and the same operation mentioned above was conducted. The treatment was repeated three times in total to remove the PVA in the nonwoven fabric completely by extraction. Based on the weight change before and after the treatment, the proportion of the PVA relative to the nonwoven fabric was determined.

[Coverage of Nonwoven Fabric Surface with PVA]

The constituting elements and bonding state of the nonwoven fabric surface were analyzed by an X-ray photoelectron spectroscopy (XPS), and the proportion of the PVA occupied in the surface of the nonwoven fabric was calculated based on the results.

[Water Content of Nonwoven Fabric]

A nonwoven fabric sample of 30 centimeters square was dried at 105° C. overnight. The water content of the nonwoven fabric was determined based on the weight change before and after the drying.

[Mean Fiber Diameter]

In a courtesy photograph of a nonwoven fabric sample, which was taken by a microscope of 1000 magnifications, 10 pieces of fiber were sampled at random. Each fiber diameter of these fibers was measured, and the average value was considered as the mean fiber diameter.

[Fabric Weight]

The fabric weight was measured in accordance with JIS L1906 "Test methods for non-woven fabrics made of filament yarn".

[Tensile Strength]

The tensile strength was measured in accordance with JIS L1906 "Test methods for non-woven fabrics made of filament yarn".

[Bending Resistance]

The bending resistance was measured in accordance with JIS L1906 "Test methods for non-woven fabrics made of filament yarn" [Flexibility A method (cantilever method)].

[Absorbing Height]

The absorbing height was determined according to JIS L1018-70 "Test methods for knitting fabrics" [Water absorbency B method (Byreck method) KRT No.411-2]. A load was attached to the lower end of a nonwoven fabric of 2.5 cm by 32 cm. The fabric sample was submerged in an aqueous ink (ink/water=1/5) so that one centimeter width from the bottom was soaked in the aqueous ink. The risen distance (or height) of the water was measured when the fabric sample was maintained for 10 minutes in such a state. Incidentally, the nonwoven fabric to be used in this method was immersed in a hot water of 80° C. for one hour in advance.

[Water Retention]

A nonwoven fabric of 20 centimeters square was absolutely dried beforehand, and weighed out accurately. The nonwoven fabric was immersed in 500 ml of 20° C. pure water for 5 minutes and pulled out of the water, and then the pulled state was maintained for about 30 seconds. The total weight of the nonwoven fabric in the time at which no droplet become to fall was weighed out accurately to determine the water retention of the nonwoven fabric.

[Wiping Property (Quick Absorbency)]

One gram of a distilled water was charged in a watch glass (diameter: 9 cm), and a nonwoven fabric of 5 centimeters square was unfolded and put above water of the watch glass. After 5 seconds, the nonwoven fabric was quickly removed from the watch glass by pinching one corner of the nonwoven fabric with tweezers, and the remaining water amount on the watch glass was measured.

[Air Permeability]

The air permeability was measured in accordance with JIS L1906 "Test methods for non-woven fabrics made of filament yarn".

[Crimp Ratio]

The crimp ratio was determined according to JIS L1015. However, since it was extremely difficult to measure the crimp ratio by using a piece of the ultra-fine fiber, the measurement was conducted in an ultra-fine fiber bundle. That is, an ultra-fine fiber bundle present in the surface of the nonwoven fabric sample was taken out, the length before and after smoothing the crimp of the fiber bundle was measured, and the percentage of the length contracted by the crimp (the difference between in length before and after smoothing the crimp of the fiber bundle) relative to the length of the crimp-smoothed fiber bundle was determined.

[Oxidation Resistance]

The oxidation resistance was determined in accordance with JIS-P8113. A nonwoven fabric sample was immersed in a mixed aqueous solution (50° C.) of 5% $KMnO_4$ (250 ml) and 30% KOH (50 ml) for one hour. The tensile strength before and after the immersing treatment was measured, and the retention (%) was determined.

[Electrolytic Solution Retentivity]

A battery separator of 5 centimeters square was immersed in a 30% KOH aqueous solution at 20° C. for 30 minutes and pulled out of the solution, and then the pulled state was maintained for about 30 seconds. The total weight of the nonwoven fabric in the time at which no droplet become to fall was weighed out accurately to determine the solution amount (%) of the separator (i.e., solution retention (%) of the separator).

EXAMPLE 1

[Production of Ethylene-Modified PVA]

To a 100 L vessel for pressure reaction, equipped with a stirrer, a nitrogen-introducing port, an ethylene-introducing port and an initiator-adding port, 29.0 kg of vinyl acetate and 31.0 kg of methanol were fed. The mixture was heated to 60° C., and then the atmosphere of the reaction system was replaced with nitrogen gas by bubbling for 30 minutes. Then, ethylene was fed into the reaction vessel so that the pressure of the reaction vessel become 5.6 kg/cm$^2$ ($5.5\times10^5$ Pa). AMV (2,2'-azobis(4 -methoxy-2,4-dimethylvaleronitrile)) was dissolved as an initiator in methanol to prepare an initiator solution having a concentration of 2.8 g/L, and the atmosphere of the system was replaced with nitrogen gas by bubbling. The inner temperature of the reaction vessel was adjusted to 60° C., and then 170 ml of the initiator solution was poured into the reaction vessel to start the polymerization reaction. During the polymerization, the reaction vessel was maintained at a pressure of 5.6 kg/cm$^2$ ($5.5\times10^5$ Pa) by introducing ethylene thereinto and at a temperature of 60° C., and the polymerization reaction was conducted by adding AMV continuously to the vessel at a rate of 610 ml/hr using the initiator solution. At the time when the polymerization rate become 68% after 9.5 hours, the polymerization reaction was stopped by cooling the system. The reaction system was released to remove ethylene, and then the removal of ethylene was perfected by bubbling with nitrogen gas. Thereafter, a remaining unreacted vinyl acetate monomer in the reaction mixture was evaporated under a reduced pressure to be removed, and a polyvinyl acetate was obtained as a methanol solution thereof.

Methanol was added to the obtained polyvinyl acetate solution to adjust the polyvinyl acetate concentration to 50%. To 2.0 kg of the resultant methanol solution of the polyvinyl acetate (polyvinyl acetate in the solution: 1.0 kg) was added 0.47 kg of an alkali solution (a methanol solution containing 10% NaOH) for saponification [that is, molar ratio (MR) of NaOH relative to vinyl acetate unit in polyvinyl acetate was 0.10]. About after 5 minutes from the alkali addition, a resultant gelated product was pulverized by a pulverizer, and was allowed to stand at 60° C. for 3 hours to go on the saponification reaction. Thereafter, 10 kg of a mixed solution of a 0.5% acetic acid aqueous solution and methanol (acetic acid aqueous solution/methanol=20/80 (weight ratio)) was added to the saponified product to neutralize the remaining alkali. The completion of the neutralization was confirmed using a phenolphthalein indicator, and then the reaction product was filtrated to give a white solid PVA. The PVA was added to 20.0 kg of a mixed solution of water and methanol (water/methanol=20/80 (weight ratio)), and was allowed to stand at a room temperature for 3 hours for washing. The washing operation was repeated three times. Then, 10.0 kg of methanol were further added to the washed matter, and the mixture was allowed to stand at a room temperature for 3 hours for washing. Thereafter, the resultant was centrifuged for removing liquid, and thus obtained PVA was allowed to stand at 70° C. for 2 days in a drying machine to give a dried PVA (PVA-1).

The saponification degree of the obtained ethylene-modified PVA was 99.1 mol %. Moreover, the modified PVA was ashed and dissolved in an acid. The sodium content of the resulting matter measured by an atomic absorption photometer was 0.0012 parts by weight relative to 100 parts by weight of the modified PVA.

Moreover, n-hexane was dissolved in the methanol solution of the polyvinyl acetate, obtained by removing the unreacted vinyl acetate monomer after the polymerization, to precipitate the polyvinyl acetate, and the precipitate was dissolved in acetone to be purified. The reprecipitation for purification was conducted three times, and then the resulting matter was dried under a reduced pressure at 80° C. for 3 days to give a purified polyvinyl acetate. The purified polyvinyl acetate was dissolved in DMSO-d6, and H-NMR thereof was measured using a 500 MHz proton NMR (manufactured by JEOL, "GX-500") at 80° C. to determine the ethylene content of the polyvinyl acetate as 8.7 mol %.

The methanol solution of the polyvinyl acetate after removing the unreacted monomer was saponified in an alkali molar ratio of 0.5, and pulverization was conducted. The pulverized matter was allowed to stand at 60° C. for 5 hours to go on the saponification reaction. Thereafter, the resulting matter was subjected to a methanol Soxhlet for 3 days, and dried under a reduced pressure at 80° C. for 3 days to give a purified ethylene-modified PVA. The average degree of polymerization of the PVA was measured in accordance with a conventional method, JIS K6726, and determined as 340. Further, a 5% aqueous solution of the purified modified PVA was prepared, and a cast film having a thickness of 10 μm was created. The film was dried under a reduced pressure at 80° C. for one day, and then the melting point of the PVA was measured according to the above-mentioned method by a DSC (Mettler-Toledo K.K., "TA3000"), and shown as 212° C. (Table 1).

TABLE 1

| | PVA | | | | | | Pelletizing | |
|---|---|---|---|---|---|---|---|---|
| | Polymerization degree | Saponification degree (mol %) | Modifier | Modifying amount (mol %) | Sodium ion (parts by weight) | Melting point (° C.) | Temperature (° C.) | Plasticizer (parts by weight) |
| PVA-1 | 340 | 99.1 | ethylene | 8.7 | 0.0012 | 212 | 230 | — |
| PVA-2 | 230 | 90.7 | none | — | 0.0007 | 190 | 200 | 10 |
| PVA-3 | 560 | 98.0 | polyoxyalkylene group | 2.0 | 0.04 | 192 | 200 | 8 |
| PVA-4 | 400 | 98.8 | propylene | 3.0 | 0.07 | 205 | 220 | — |
| PVA-5 | 350 | 99.6 | ethyl vinyl ether | 6.2 | 0.008 | 189 | 205 | — |
| PVA-6 | 180 | 98.5 | ethylene | 10.5 | 0.004 | 210 | 225 | — |
| PVA-7 | 1100 | 98.2 | ethylene | 7.1 | 0.00008 | 208 | 220 | 10 |
| PVA-8 | 340 | 88.0 | ethylene | 8.7 | 0.0004 | 173 | 190 | — |
| PVA-9 | 360 | 98.7 | ethylene | 3.0 | 0.0002 | 218 | 230 | 8 |
| PVA-10 | 330 | 97.9 | ethylene | 13.0 | 0.01 | 197 | 210 | — |
| PVA-11 | 620 | 94.0 | ethylene | 18.0 | 0.003 | 174 | 185 | 5 |
| PVA-12 | 340 | 99.8 | ethylene | 8.7 | 0.002 | 216 | 225 | 8 |
| PVA-13 | 510 | 99.0 | ethylene | 9.0 | 0.0009 | 211 | 225 | — |

The PVA-1 obtained in the above was molten and extruded at a preset temperature of 220° C. and a screw rotation speed of 200 rpm by means of a biaxial extruder (manufactured by The Japan Steel Works, Ltd., 30 mmϕ) to make a pellet (Table 1).

Thus obtained pellet of the PVA (PVA-1), and a polyethylene terephthalate (PET) having an intrinsic viscosity of 0.7 and a melting point of 255° C. were prepared, each was heated by a separate extruder for melt-kneading, and guided to a 16-separated (orange cross-sectional) conjugate spinning head at 280° C. so that the weight ratio of PET relative to PVA in a conjugate continuous fiber constituting a nonwoven fabric [PET/PVA] become 85/15. Then, the guided matter was discharged from a spinneret under the following conditions: a nozzle diameter of 0.35 mmϕ×1008 holes, a discharge rate of 1050 g/min. and a shear rate of 2500 $sec^{-1}$. The group of spun filaments was drawn and made thin at a drawing rate of 3000 m/min. by an ejector under cooling with cold wind of 20° C., wherein the ejector discharged a high-speed air and was located at a distance of 80 cm from the nozzle. Then, the group of the opened filaments was collected and deposited on a collecting conveyer apparatus rotating endlessly to form a web composed of continuous fibers. Regarding the spinning state, there was no break of the fibers and the shape of the cross section was extremely excellent. FIG. 1 shows the sectional view of the obtained conjugate continuous fiber (the sectional view in the direction perpendicular to the long direction). The cross sectional form (or structure) of the fiber is a 16-separated form [orange cross-section (1)] composed of a phase 1 comprising the water-soluble thermoplastic polyvinyl alcohol and a phase 2 comprising the thermoplastic polymer.

Thereafter, the web was passed between an uneven-patterned embossed roll and a flat roll heated at 180° C. under a linear load of 50 kgf/cm (490 N/cm), and the embossed parts were thermocompressed to give a nonwoven fabric composed of 16-divided conjugate continuous fibers having a fabric weight of 121 g/$m^2$ and a single fiber fineness of 3.5 dtex. The obtained nonwoven fabric was uniform and extremely excellent. The production conditions of the nonwoven fabric composed of conjugate continuous fibers were shown in Tables 2 to 4.

TABLE 2

| | Examples | | | | | | | | | | |
|---|---|---|---|---|---|---|---|---|---|---|---|
| | 1 | 2 | 3 | 4 | 5 | 6 | 7 | 8 | 9 | 10 | 11 |
| Thermoplastic polymer | PET | PET | PET | PET | PET | PET | PET | PET | PP | PET | EVOH-1 |
| PVA | PVA-1 | PVA-2 | PVA-3 | PVA-4 | PVA-5 | PVA-6 | PVA-7 | PVA-8 | PVA-1 | PVA-1 | PVA-1 |
| Composite formulation | 85/15 | 85/15 | 85/15 | 85/15 | 85/15 | 85/15 | 85/15 | 85/15 | 40/60 | 90/10 | 85/15 |
| Form of conjugate cross section | orange (1) | orange (1) | orange (1) | orange (1) | orange (1) | orange (1) | orange (1) | orange (1) | orange (1) | orange (1) | orange (2) |
| Production conditions of nonwoven fabric composed of continuous fibers | | | | | | | | | | | |
| Spinning temp. (° C.) | 280 | 280 | 280 | 280 | 280 | 280 | 280 | 280 | 230 | 280 | 230 |
| Drawing rate (m/min.) | 3000 | 1500 | 1800 | 2500 | 2500 | 2800 | 2500 | 2800 | 2000 | 3000 | 1800 |
| Embossing temp. (° C.) | 180 | 180 | 180 | 180 | 180 | 180 | 180 | 180 | — | — | 120 |
| Production results | | | | | | | | | | | |
| Spinning state | A | B to C | B to C | A to B | B | A to B | B | A to B | A | A | A to B |
| State of nonwoven fabric | A | B to C | B to C | B | B | A to B | A to B | A to B | A | A | A to B |
| Hot water extraction of PVA | | | | | | | | | | | |
| Extraction temp. (° C.) | 95 | 90 | 90 | 90 | 90 | 95 | 95 | 90 | 95 | 90 | 90 |
| Extraction time (min.) | 40 | 40 | 40 | 40 | 40 | 40 | 40 | 40 | 30 | 15 | 20 |
| water bath ratio | 330/1 | 290/1 | 300/1 | 340/1 | 340/1 | 330/1 | 370/1 | 340/1 | 400/1 | 370/1 | 460/1 |

TABLE 2-continued

| | Examples | | | | | | | | | | |
|---|---|---|---|---|---|---|---|---|---|---|---|
| | 1 | 2 | 3 | 4 | 5 | 6 | 7 | 8 | 9 | 10 | 11 |
| Drying temp. (° C.) | 80 | 80 | 80 | 80 | 80 | 80 | 80 | 80 | room temp. | 80 | 80 |
| Drying time (min.) | 3 | 3 | 3 | 3 | 3 | 3 | 3 | 3 | 20 | 3 | 3 |

TABLE 3

| | Examples | | | | | | | | | | |
|---|---|---|---|---|---|---|---|---|---|---|---|
| | 12 | 13 | 14 | 15 | 16 | 17 | 18 | 19 | 20 | 21 | 22 |
| Thermoplastic polymer | PET | PP | PET | Ny | EVOH-2 | EVOH-2 | PP | PET | PET | PET | PET |
| PVA | PVA-9 | PVA-10 | PVA-11 | PVA-12 | PVA-13 | PVA-13 | PVA-1 | PVA-1 | PVA-1 | PVA-1 | PVA-1 |
| Composite formulation | 60/40 | 70/30 | 85/15 | 70/30 | 85/15 | 60/40 | 60/40 | 85/15 | 85/15 | 85/15 | 85/15 |
| Form of conjugate cross section | lamination | lamination | orange (2) | laminate | orange (1) | islands-in-the-sea | islands-in-the-sea | orange (1) | orange (1) | orange (1) | orange (1) |
| Production conditions of nonwoven fabric composed of continuous fibers | | | | | | | | | | | |
| Spinning temp.(° C.) | 280 | 230 | 280 | 270 | 230 | 230 | 230 | 280 | 280 | 280 | 280 |
| Drawing rate (m/min.) | 2800 | 2000 | 2800 | 2800 | 2200 | 2000 | 2000 | 3000 | 3000 | 3000 | 3000 |
| Embossing temp. (° C.) | 160 | 150 | 180 | 150 | 120 | 120 | 150 | 180 | 180 | 180 | 180 |
| Production results | | | | | | | | | | | |
| Spinning state | A to B | A | A to B | A | A | A | A | A | A | A | A |
| State of nonwoven fabric | A | A | A | A | A to B | A to B | A | A | A | A | A |
| Hot water extraction of PVA | | | | | | | | | | | |
| Extraction temp.(° C.) | 90 | 95 | 120 | 90 | 90 | 95 | 105 | 95 | 95 | 95 | 95 |
| Extraction time (min.) | 30 | 15 | 40 | 15 | 30 | 20 | 20 | 40 | 40 | 40 | 40 |
| water bath ratio | 630/1 | 250/1 | 420/1 | 360/1 | 400/1 | 550/1 | 270/1 | 330/1 | 330/1 | 80/1 | 2500/1 |
| Drying temp.(° C.) | 80 | 80 | 80 | 80 | 80 | 80 | 80 | 105 | 125 | 80 | 80 |
| Drying time (min.) | 3 | 3 | 3 | 3 | 3 | 3 | 3 | 3 | 2 | 3 | 3 |

TABLE 4

| | Comparative Examples | | | | |
|---|---|---|---|---|---|
| | 1 | 2 | 3 | 4 | 6 |
| Thermoplastic polymer | PET | PET | PP | PET | PP |
| PVA | PVA-1 | PVA-1 | PVA-1 | — | — |
| Composite formulation | 90/10 | 20/80 | 85/15 | homo | homo |
| Form of conjugate cross section | orange (2) | orange (2) | orange (1) | (spunbonded) | (meltblown) |
| Production conditions of nonwoven fabric composed of continuous fibers | | | | | |
| Spinning temp.(° C.) | 280 | 280 | 230 | 280 | 240 |
| Drawing rate (m/min.) | 3000 | 2800 | 2000 | 4000 | — |
| Embossing temp.(° C.) | 180 | 150 | 150 | 150 | — |
| Production results | | | | | |
| Spinning state | A | A to B | A | A | A |
| State of nonwoven fabric | A | A | A | A | A |
| Hot water extraction of PVA | | | | | |
| Extraction temp.(° C.) | 85 | 120 | 80 | — | — |
| Extraction time (min.) | 30 | 180 | 10 | — | — |
| water bath ratio | 390/1 | 460/1 | 300/1 | — | — |
| Drying temp. (° C.) | 80 | 80 | 80 | — | — |
| Drying time (min.) | 3 | 3 | 3 | — | — |

Regarding the obtained nonwoven fabric of 50 m long, an extractive treatment of the PVA component was conducted by using a circular dyeing machine (water bath: 800 L, weight ratio of water in bath relative to nonwoven fabric (or water bath ratio): 330/1, and rotational speed of nonwoven fabric: about 50 m/min.). After putting the nonwoven fabric composed of conjugate continuous fibers into the water bath, the water in the bath was heated from a room temperature to 95° C. at a rate of about 5° C./min., and the fabric was treated with the hot water in the bath of 95° C. for 20 minutes. The extraction treatment was carried out twice (that is, the processing time of the treatment at 95° C. was totally 40 minutes), and the PVA component in the nonwoven fabric composed of conjugate continuous fibers was removed by extraction. The proportion of the PVA relative to the nonwoven fabric was 0.04% after the extractive removing.

Then, the resultant web was subjected to a hot-air drying continuously at 80° C. for 3 minutes to obtain a nonwoven fabric composed of ultra-fine continuous fibers of the polyethylene terephthalate. The moisture percentage of the nonwoven fabric after the drying was 0.18%. The ultra-fine continuous fiber constituting this nonwoven fabric has a wedge-shaped (or V-shaped or cuneal) cross section, and the nonwoven fabric was composed of a bundle of the eight fibers each having the wedge-shaped cross section. Moreover, the wedge-shaped ultra-fine fiber has a fine (or minute) crimp, and regarding the degree of the crimp, the fiber length increased about 8% when the crimp was smoothed.

In the nonwoven fabric composed of ultra-fine continuous fibers obtained by the above manner, the evaluation results of the coverage of the PVA, the fineness, the fabric weight and various basic physical properties were described in Tables 5 to 7.

TABLE 5

| | | Examples | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Thermoplastic polymer | | PET | PET | PET | PET | PET | PET | PET | PET | PP | PET | EVOH-1 |
| PVA residual ratio (%) | | 0.04 | 0.04 | 0.06 | 0.05 | 0.03 | 0.04 | 0.03 | 0.05 | 0.02 | 2.5 | 1.3 |
| Coverage of PVA (%) | | 45 | 43 | 48 | 45 | 39 | 42 | 40 | 43 | 37 | 53 | 35 |
| Moisture percentage (%) | | 0.18 | 0.20 | 0.25 | 0.22 | 0.16 | 0.17 | 0.17 | 0.21 | 0.07 | 0.28 | 0.26 |
| Fineness (dtex) | | 0.35 | 0.42 | 0.43 | 0.39 | 0.40 | 0.36 | 0.37 | 0.36 | 0.12 | 0.37 | 0.42 |
| Crimp ratio (%) | | 8 | 3 | 3 | 5 | 4 | 7 | 8 | 4 | 13 | 3 | 4 |
| Fabric weight (A) ($g/m^2$) | | 104 | 119 | 115 | 100 | 101 | 103 | 91 | 100 | 50 | 123 | 93 |
| Tensile strength | Longitudinal | 86 | 84 | 79 | 77 | 75 | 80 | 77 | 79 | 33 | 247 | 68 |
| (B) (N/5 cm) | Transversal | 74 | 77 | 76 | 72 | 72 | 79 | 76 | 77 | 30 | 205 | 58 |
| (B)/(A) | Longitudinal | 0.83 | 0.71 | 0.69 | 0.77 | 0.74 | 0.78 | 0.85 | 0.79 | 0.66 | 2.01 | 0.73 |
| | Transversal | 0.71 | 0.65 | 0.66 | 0.72 | 0.71 | 0.77 | 0.84 | 0.77 | 0.60 | 1.67 | 0.62 |
| Bending | Longitudinal | 82 | 89 | 92 | 88 | 83 | 81 | 77 | 84 | 67 | 41 | 98 |
| resistance (mm) | Transversal | 83 | 88 | 90 | 85 | 82 | 81 | 74 | 81 | 56 | 38 | 92 |
| Absorbing height | Longitudinal | 175 | 143 | 142 | 156 | 151 | 163 | 159 | 166 | 95 | 209 | 161 |
| (mm/10 min.) | Transversal | 158 | 141 | 132 | 155 | 149 | 158 | 144 | 161 | 88 | 197 | 144 |
| Water retention (%) | | 704 | 521 | 509 | 588 | 579 | 690 | 651 | 679 | 506 | 892 | 732 |
| Wiping property (g) | | 0.036 | 0.108 | 0.110 | 0.088 | 0.080 | 0.041 | 0.069 | 0.043 | 0.288 | 0.014 | 0.054 |
| Air permeability ($ml/cm^2/sec.$) | | 25 | 72 | 79 | 41 | 55 | 29 | 38 | 31 | 124 | 18 | 90 |

TABLE 6

| | | Examples | | | | | | | | | | |
|---|---|---|---|---|---|---|---|---|---|---|---|---|
| | | 12 | 13 | 14 | 15 | 16 | 17 | 18 | 19 | 20 | 21 | 22 |
| Thermoplastic polymer | | PET | PP | PET | Ny | EVOH-2 | EVOH-2 | PP | PET | PET | PET | PET |
| PVA residual ratio (%) | | 0.4 | 3.9 | 0.08 | 3.7 | 0.7 | 0.03 | 0.03 | 0.04 | 0.04 | 3.5 | 0.02 |
| Coverage of PVA (%) | | 42 | 47 | 33 | 49 | 51 | 35 | 18 | 45 | 45 | 50 | 39 |
| Moisture percentage (%) | | 0.27 | 0.15 | 0.20 | 0.36 | 0.28 | 0.19 | 0.12 | 0.02 | 0.003 | 0.34 | 0.11 |
| Fineness (dtex) | | 0.21 | 0.26 | 0.45 | 0.30 | 0.28 | 0.15 | 0.16 | 0.35 | 0.35 | 0.35 | 0.35 |
| Crimp ratio (%) | | 9 | 2 | 21 | 7 | 8 | 25 | 12 | 7 | 8 | 8 | 6 |
| Fabric weight (A) ($g/m^2$) | | 38 | 112 | 82 | 77 | 85 | 44 | 88 | 104 | 104 | 105 | 104 |
| Tensile strength | Longitudinal | 26 | 90 | 119 | 103 | 71 | 28 | 62 | 85 | 89 | 91 | 83 |
| (B) (N/5 cm) | Transversal | 22 | 76 | 96 | 77 | 60 | 24 | 59 | 72 | 75 | 80 | 82 |
| (B)/(A) | Longitudinal | 0.68 | 0.80 | 1.45 | 1.34 | 0.84 | 0.64 | 0.70 | 0.82 | 0.86 | 0.87 | 0.80 |
| | Transversal | 0.58 | 0.68 | 1.17 | 1.00 | 0.70 | 0.55 | 0.67 | 0.69 | 0.72 | 0.76 | 0.79 |
| Bending | Longitudinal | 46 | 91 | 71 | 78 | 84 | 65 | 77 | 85 | 86 | 94 | 84 |
| resistance (mm) | Transversal | 34 | 90 | 66 | 72 | 79 | 64 | 73 | 84 | 86 | 92 | 83 |
| Absorbing height | Longitudinal | 81 | 131 | 158 | 162 | 169 | 75 | 78 | 124 | 63 | 153 | 55 |
| (mm/10 min.) | Transversal | 67 | 130 | 149 | 158 | 167 | 69 | 72 | 111 | 49 | 148 | 38 |
| Water retention (%) | | 821 | 403 | 654 | 687 | 660 | 781 | 590 | 553 | 389 | 601 | 335 |
| Wiping property (g) | | 0.112 | 0.311 | 0.053 | 0.101 | 0.040 | 0.097 | 0.212 | 0.179 | 0.458 | 0.089 | 0.465 |
| Air permeability ($ml/cm^2/sec.$) | | 177 | 20 | 81 | 48 | 26 | 190 | 54 | 29 | 27 | 25 | 33 |

TABLE 7

| | Comparative Examples | | | | | | | Example |
|---|---|---|---|---|---|---|---|---|
| | 1 | 2 | 3 | 4 | 5 | 6 | 7 | 23 |
| Thermoplastic polymer | PET | PET | PP | PET | PET | PP | PP | PP (lamination) |
| PVA residual ratio (%) | 3 | 0.0005 | 8.3 | 0 | 1.4 | 0 | 1.2 | — |
| Coverage of PVA (%) | 36 | 13 | 58 | 0 | 34 | 0 | 31 | — |
| Moisture percentage (%) | 0.25 | 0.04 | 0.41 | 0.00 | 0.30 | 0.00 | 0.27 | — |

TABLE 7-continued

| | | Comparative Examples | | | | | | | Example |
|---|---|---|---|---|---|---|---|---|---|
| | | 1 | 2 | 3 | 4 | 5 | 6 | 7 | 23 |
| Fineness (dtex) | | 0.78 | 0.19 | 0.20 | 1.54 | 1.54 | 0.05 | 0.05 | — |
| Crimp ratio (%) | | 6 | 28 | 1 | 0 | 0 | 0 | 0 | — |
| Fabric weight (A) (g/m$^2$) | | 93 | 55 | 115 | 84 | 85 | 100 | 103 | 150 |
| Tensile strength | Longitudinal | 113 | 40 | 89 | 88 | 91 | 23 | 25 | 385 |
| (B) (N/5 cm) | Transversal | 96 | 36 | 72 | 73 | 76 | 19 | 20 | 372 |
| (B)/(A) | Longitudinal | 1.21 | 0.72 | 0.77 | 1.05 | 1.07 | 0.23 | 0.24 | 2.57 |
| | Transversal | 1.03 | 0.65 | 0.63 | 0.87 | 0.89 | 0.19 | 0.19 | 2.48 |
| Bending resistance | Longitudinal | 94 | 45 | 125 | 108 | 115 | 60 | 80 | 134 |
| (mm) | Transversal | 92 | 43 | 115 | 93 | 101 | 59 | 68 | 121 |
| Absorbing height | Longitudinal | 39 | 21 | 142 | 0 | 10 | 0 | 41 | — |
| (mm/10 min.) | Transversal | 28 | 17 | 136 | 0 | 8 | 0 | 28 | — |
| Water retention (%) | | 315 | 259 | 456 | 211 | 244 | 171 | 431 | — |
| Wiping property (g) | | 0.609 | 0.721 | 0.297 | 0.801 | 0.773 | 0.941 | 0.254 | — |
| Air permeability (ml/cm$^2$/sec.) | | 234 | 108 | 22 | 279 | 234 | 30 | 27 | 7 |

Moreover, the wiper performance in the nonwoven fabric composed of ultra-fine continuous fibers obtained by the above manner was evaluated. Tables 5 to 7 show the evaluation results of the absorbing height, the water retention, and the wiping property (quick absorbency).

In each evaluation, the nonwoven fabric shows excellent performance.

Further, to examine the filter performance of the nonwoven fabric composed of ultra-fine continuous fibers, the measurement of the air permeability was conducted. The results are shown in Tables 5 to 7.

It is confirmed that the nonwoven fabric has a low air-permeability and is excellent in filtration property.

EXAMPLES 2 to 8

A nonwoven web composed of a conjugate continuous fiber was obtained under the same conditions as Example 1 except for using a PVA described in Table 1 instead of the PVA used in Example 1. The spinning state is shown in Tables 2 to 4.

Regarding the obtained nonwoven fabric composed of conjugate continuous fibers, the PVA component was extracted using a circular dyeing machine as with Example 1, and hot-air dried at 80° C. for 3 minutes to give an objective nonwoven fabric composed of ultra-fine continuous fibers. Also in each nonwoven fabric, the nonwoven fabric was composed of a bundle of the eight ultra-fine fibers.

In the obtained nonwoven fabric composed of ultra-fine continuous fibers, the evaluation results of the amount of the remaining PVA, the coverage of the PVA, the moisture percentage, the fineness, the fabric weight and various basic physical properties were described in Tables 5 to 7. Further, the evaluation results of the wiper performance and filter performance is also shown in Tables 5 to 7.

EXAMPLES 9 to 18

A nonwoven web composed of a conjugate continuous fiber was obtained under the same conditions as Example 1 except for using a PVA described in Table 1 instead of the PVA used in Example 1, using a spinneret having a cross section shown in Tables 2 to 4 and a thermoplastic polymer shown in Tables 2 to 4, and suitably adjusting a distance from the nozzle to the ejector and a line net rate, by adopting a spinning condition described in Tables 2 to 4. Then, the web was partially thermocompressed at an embossing temperature described in Tables 2 to 4 to give a nonwoven fabric composed of conjugate continuous fibers.

Figure 2:
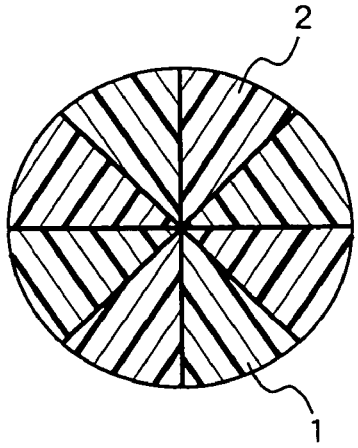
FIG. 2 is a sectional view showing another embodiment of a cross-sectional form (or shape) of a conjugate continuous fiber used in the present invention.
Figure 3:
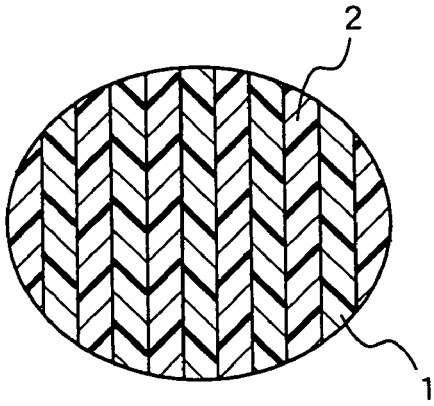
FIG. 3 is a sectional view showing still another embodiment of a cross-sectional form (or shape) of a conjugate continuous fiber used in the present invention.
Figure 4:
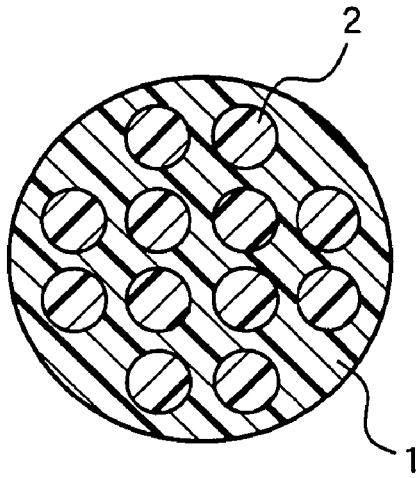
FIG. 4 is a sectional view showing a further another embodiment of a cross-sectional form (or shape) of a conjugate continuous fiber used in the present invention.

The weight ratio of polymers in the conjugate fiber was adjusted by varying an introduction amount of the polymer into the pack. Moreover, FIGS. 2 to 4 show cross-sectional forms of the conjugate fibers, other than the above-mentioned orange cross-section (1). FIG. 2 shows other orange cross-section, and the cross section of the fiber has an 8-divided cross-sectional form comprising a phase 1 composed of the water-soluble thermoplastic polyvinyl alcohol and a phase 2 composed of the thermoplastic polymer (orange cross-section (2)). FIG. 3 shows a cross-sectional form of a laminate-shaped conjugate fiber comprising a phase 1 composed of the water-soluble thermoplastic polyvinyl alcohol and a phase 2 composed of the thermoplastic polymer. The laminate-shaped conjugate fiber was obtained by guiding so that the phase 1 and the phase 2 had six layers and five layers, respectively, in the cross section of the fiber. FIG. 4 shows a cross-sectional form of an islands-in-the-sea-shaped conjugate fiber comprising a phase 1 composed of the water-soluble thermoplastic polyvinyl alcohol and a phase 2 composed of the thermoplastic polymer. The islands-in-the-sea-shaped conjugate fiber was obtained by guiding so that the thermoplastic polymer and the PVA constituted island parts and a sea part, respectively, in a cross section of the fiber.

In Examples 9 and 10 the roll was not heated, and the web was only passed under a linear load of 50 kgf/cm (490 N/cm). Further, in Example 10 the conjugate continuous fiber was treated for separation by jetting a pressurized water with the use of a hydroentanglement machine (water pressure: 150 kgf/cm (14700 MPa), passing rate of nonwoven fabric: 3 m/min.).

From the obtained nonwoven fabric composed of conjugate continuous fibers, the PVA component was extracted, and the nonwoven fabric was dried to give an objective nonwoven fabric composed of ultra-fine continuous fibers. In Examples 9 to 11, the nonwoven fabric was treated using a winch dyeing machine (water bath: 1000 L, 90° C.×60 minutes, rotational speed of nonwoven fabric: about 100 m/min.). In Examples 12 to 17, the proportion of the PVA relative to the nonwoven fabric was adjusted by using a circular dyeing machine similar to Example 1 and varying the hot water temperature and the treating time.

In the obtained nonwoven fabric composed of ultra-fine continuous fibers, the evaluation results of the amount of the remaining PVA, the coverage of the PVA, the moisture percentage, the fineness, the fabric weight and the basic physical properties are shown in Tables 5 to 7. Further, the evaluation results of the wiper performance and the filter performance are also shown in Tables 5 to 7. Incidentally, also in the nonwoven fabric in each example., the nonwoven fabric was composed of a bundle of the six ultra-fine fibers.

EXAMPLES 19 and 20

A production of a nonwoven web comprising a conjugate continuous fiber, an embossing treatment and an extraction were conducted under the same conditions as Example 1. Thereafter, the web was subjected to a hot-air drying under condition shown in Tables 2 to 4 to obtain an objective nonwoven fabric composed of ultra-fine continuous fibers. In thus obtained nonwoven fabric composed of ultra-fine continuous fibers, the evaluation results of the amount of the remaining PVA, the coverage of the PVA, the moisture percentage, the fineness, the fabric weight and the basic physical properties are shown in Tables 5 to 7. Tables 5 to 7 also show the evaluation results of the wiper performance and the filter performance. Incidentally, also in the nonwoven fabric in each example, the nonwoven fabric was composed of a bundle of the ultra-fine fibers.

EXAMPLES 21 AND 22

A production of a nonwoven web comprising a conjugate continuous fiber, an embossing treatment and an extraction were conducted under the same conditions as Example 1. Thereafter, the PVA was extracted from the web in a water bath ratio shown in Tables 2 to 4, and then the web was subjected to a hot-air drying at 80° C. for 3 minutes to obtain an objective nonwoven fabric composed of ultra-fine continuous fibers. In the obtained nonwoven fabric composed of ultra-fine continuous fibers, the evaluation results of the amount of the remaining PVA, the coverage of the PVA, the moisture percentage, the fineness, the fabric weight and the basic physical properties are shown in Tables 5 to 7. Incidentally, also in the nonwoven fabric in each example, the nonwoven fabric was composed of a bundle of the ultra-fine fibers.

COMPARATIVE EXAMPLES 1 TO 3

A nonwoven web composed of a conjugate continuous fiber was obtained under the same conditions as Example 1 except for using a PVA described in Table 1 instead of the PVA used in Example 1, adopting the water-insoluble thermoplastic resin and a spinning condition shown in Tables 2 to 4, and adjusting a distance from the nozzle to the ejector and a line net rate. Then, the web was partially thermocompressed at an embossing temperature described in Tables 2 to 4 to give a nonwoven fabric composed of conjugate continuous fibers. The weight ratio of polymers in the conjugate fiber was adjusted by varying an introduction amount of the polymer into the pack. The spinning condition in each comparative example was good.

In the obtained nonwoven fabric composed of conjugate continuous fibers, similar to Example 1, the PVA component was extracted from the nonwoven fabric, the nonwoven fabric was dried to give an objective nonwoven fabric composed of ultra-fine continuous fibers. The proportion of the PVA relative to the nonwoven fabric was adjusted by suitably varying the hot water temperature and the treating time.

In the nonwoven fabric composed of ultra-fine continuous fibers, the evaluation results of the amount of the remaining PVA, the coverage of the PVA, the moisture percentage, the fineness, the fabric weight and various performance are shown in Tables 5 to 7.

Regarding Comparative Example 1, the fineness of the nonwoven fabric composed of continuous fibers was large, and as a result, the absorbing height of the nonwoven fabric was deteriorated. Further, since the air permeability was also large, the nonwoven fabric was inferior in filtration property to some degree in the case of utilizing as a filter substrate.

Regarding Comparative Example 2, the PVA was removed almost absolutely from the web by the hot water treatment, and thereby the nonwoven fabric was deteriorated in absorbing height and inferior in wiping performance.

Moreover, about Comparative Example 3, the residual ratio of the PVA after the hot water treatment was high, and only the nonwoven fabric composed of ultra-fine continuous fibers inferior to flexibility was obtained.

COMPARATIVE EXAMPLE 4

A polyethylene terephthalate having an intrinsic viscosity of 0.7 and a melting point of 255° C. was prepared. The polyethylene terephthalate was heated in an extruder to be melt-kneaded, guided to a spinning head of 280° C., and discharged from a spinneret under the following conditions: a nozzle diameter of 0.35 mmϕ×1008 holes, a discharge rate of 620 g/min. and a shear rate of 3000 $sec^{-1}$. Then, the group of spun filaments was drawn and made thin at a drawing rate of 4000 m/min. by an ejector under cooling with cold wind of 20° C., wherein the ejector discharged a high-speed air and was located at a distance of 80 cm from the nozzle, and the group of the opened filaments was collected and deposited on a collecting conveyer apparatus rotating endlessly to form a web composed of continuous fibers of the polyethylene terephthalate.

Thereafter, the web was passed between a uneven-patterned embossed roll and a flat roll heated at 180° C. under a linear load of 50 kgf/cm (490 N/cm), and the embossed parts were partially thermocompressed to give a nonwoven fabric composed of continuous fibers having a fabric weight of 84 $g/m^2$ and a single fiber fineness of 1.54 dtex.

In the obtained nonwoven fabric composed of continuous fibers, the evaluation results of the amount of the remaining PVA, the coverage of the PVA, the moisture percentage, the fineness, the fabric weight and various performances are shown in Tables 5 to 7.

The nonwoven fabric composed of only polyethylene terephthalate does not show liquid absorbency and further is large in air permeability. Such the nonwoven fabric is therefore inferior in filtration property.

COMPARATIVE EXAMPLE 5

The nonwoven fabric composed of continuous fibers obtained in Comparative Example 4 was immersed in a 1% aqueous solution of PVA-1, and heat-treated at 95° C. for one hour. After the treatment, the nonwoven fabric composed of continuous fibers was pulled out of the solution, and then subjected to a hot-air drying at 80° C. for about 3 minutes in that state to give a nonwoven fabric composed of continuous fibers, containing the PVA-1 therein. The residual ratio of the PVA relative to the nonwoven fabric composed of continuous fibers was 1.4%.

Various performances by using the obtained nonwoven fabric composed of continuous fibers were evaluated. The results are shown in Tables 5 to 7.

The presence of the PVA in the nonwoven fabric ensures to impart water absorbency to the fabric. However, since the fiber diameter was large, the nonwoven fabric was insufficient in water absorbency and inferior in wiper performance.

COMPARATIVE EXAMPLE 6

A polypropylene having a melt flow rate (MFR) of 400 g/10 min. was melt-kneaded at 230° C. using a melt extruder. The molten polymer flow was guided to a melt blow die head, weighed on a gear pump, discharged from a meltblown nozzle having pores each of 0.3 mmϕ in diameter put in a row at 0.75 mm pitch, and at the same time, a fiber discharged by spraying a hot wind at 240° C. to the resin was collected on a conveyer for molding to obtain a nonwoven fabric composed of polypropylene-series ultra-fine fibers having a fabric weight of 100 g/m$^2$.

In the obtained nonwoven fabric composed of ultra-fine fibers, the evaluation results of the fineness, the fabric weight and various performances are shown in Tables 5 to 7.

As apparent from the results, the tensile strength was small, and it was difficult to utilize the nonwoven fabric singly.

COMPARATIVE EXAMPLE 7

The nonwoven fabric composed of ultra-fine fibers obtained in Comparative Example 6 was immersed in an aqueous solution of 1% PVA-1, and heat-treated at 95° C. for one hour. After the treatment, the nonwoven fabric composed of ultra-fine fibers was pulled out of the solution, and then continue hot-air drying at 80° C. for about 3 minutes to give a nonwoven fabric composed of ultra-fine fibers, containing the PVA-1 therein. The residual ratio of the PVA relative to the nonwoven fabric composed of ultra-fine fibers was 1.2%.

Various performances were evaluated by using the obtained nonwoven fabric composed of ultra-fine fibers. The results are shown in Tables 5 to 7.

The presence of the PVA in the nonwoven fabric ensures to impart water absorbency to the fabric. However, the fiber and the nonwoven fabric induce to generate fluff (or nap) intensively because of low strength, and therefore it was difficult to utilize the nonwoven fabric singly. Moreover, each ultra-fine fiber was independent, and did not form a bundle state like the fibers in the nonwoven fabric of the present invention.

EXAMPLE 23

The polypropylene-series nonwoven fabrics obtained in Example 6 and Comparative Example 6 were laminated, and the laminated matter was passed between an uneven-patterned embossed roll and a flat roll heated at 150° C. under a linear load of 50 kgf/cm (490 N/cm), and the embossed parts were thermocompressed to give a nonwoven fabric laminate composed of ultra-fine fibers.

Tables 5 to 7 show the evaluation results of various performances in the obtained laminate of the nonwoven fabrics.

As the result, the obtained laminate of the nonwoven fabrics with ultra-fine fibers had a high strength and a low air-permeability, and was suitable for a filter substrate.

EXAMPLES 24 TO 28

In 50 m of a nonwoven fabric composed of conjugate continuous fibers obtained in each of Examples 9, 13 and 18, conjugate continuous fibers was entangled by jetting a pressurized water using a hydroentanglement machine (150 kg/cm (14700 MPa), passing rate of nonwoven fabric: 5 m/min.).

Subsequently, an extractive treatment of the PVA component was carried out by using a circular-type dyeing machine (water bath: 800 L, rotational speed of nonwoven fabric: about 50 m/min.). After putting the nonwoven fabric composed of conjugate continuous fibers into the water bath, the water in the bath was heated from a room temperature to 95° C. at a rate of about 5° C./min., and the nonwoven fabric was further treated with the hot water in the bath of 95° C. for 15 minutes. The extraction treatment was carried out twice to extract the PVA component in the nonwoven fabric composed of conjugate continuous fibers.

The web was subjected to a hot-air drying at 80° C. for 3 minutes by a continuous treatment to give a nonwoven fabric composed of polypropylene ultra-fine continuous fibers.

Further, each nonwoven fabric composed of ultra-fine continuous fibers was passed between heated flat rolls under conditions shown in Table 8 to obtain a uniform and good battery separator.

The evaluation results of various basic physical properties in the obtained battery separator are shown in Table 8. Each evaluation showed good performance.

TABLE 8

| | | Examples | | | | | Comparative Example |
|---|---|---|---|---|---|---|---|
| | | 24 | 25 | 26 | 27 | 28 | 8 |
| Thermoplastic polymer | | PP | PP | PP | PP | PP | PP |
| PVA residual ratio (%) | | 0.14 | 0.14 | 0.14 | 2.2 | 0.05 | 0.14 |
| Fineness (dtex) | | 0.12 | 0.12 | 0.12 | 0.26 | 0.16 | 0.12 |
| Calendering | Temp. (° C.) | 80 | 80 | 120 | 80 | 80 | 120 |
| | Linear load (kgf/cm) | 100.00 | 50 | 80 | 100 | 100 | 150 |
| Thickness (μm) | | 98 | 135 | 76 | 207 | 182 | 65 |
| Fabric weight (A) (g/m$^2$) | | 52 | 52 | 52 | 113 | 91 | 52 |
| Tensile strength (B) (N/5cm) | Longitudinal | 58 | 44 | 63 | 128 | 93 | 52 |
| | Transversal | 49 | 42 | 57 | 115 | 88 | 46 |
| (B)/(A) | Longitudinal | 1.12 | 0.85 | 1.21 | 1.32 | 1.02 | 1.00 |
| | Transversal | 0.94 | 0.81 | 1.10 | 1.02 | 0.97 | 0.88 |
| Absorbing height (mm/10 min.) | Longitudinal | 65 | 81 | 43 | 83 | 50 | 22 |
| | Transversal | 58 | 73 | 39 | 71 | 46 | 15 |

TABLE 8-continued

| | Examples | | | | | Comparative Example |
|---|---|---|---|---|---|---|
| | 24 | 25 | 26 | 27 | 28 | 8 |
| Oxidation resistance (%) | 99.7 | 98.5 | 99.1 | 99.2 | 98.8 | 98.3 |
| Electrolytic solution retentivity (%) | 321 | 215 | 354 | 301 | 313 | 171 |

COMPARATIVE EXAMPLE 8

A hydroentanglement and a hot water treatment were conducted in the same conditions as in Example 24 except for using the nonwoven fabric composed of conjugate continuous fibers obtained in Example 9 and passing between heated flat rolls under the conditions shown in Table 8, to give a battery separator. The evaluation results of various basic physical properties in the obtained battery separator are described in Table 8.

The nonwoven fabric composed of ultra-fine continuous fibers, constituting a battery separator was formed into a film shape, and was deteriorated in water absorbing performance. It was therefore difficult to use the nonwoven fabric as a separator.

EXAMPLE 29

To 100 parts by weight of nickel hydroxide powder coated with cobalt hydroxide was added 20 parts by weight of an aqueous solution of carboxymethyl cellulose in terms of solid bases, and further kneaded to prepare a paste. The paste was filled in a porous nickel plate as a current collector, dried, and then rolled and molded by roller pressing to make a positive plate comprising a current collector and a nickel hydroxide-containing cathode mix supported to the current collector. The positive plate had a thickness of 680 μm and a capacity per unit volume of 580 mAh/ml.

An aqueous solution of methyl cellulose (20 parts by weight) was added to 100 parts by weight of a hydrogen storage alloy powder having a formulation shown by $LmNi_{4.0}CO_{0.4}Mn_{0.3}Al_{0.3}$ and mixed together to prepare a paste. This paste was applied to both sides of a punching metal as a current collector in each thickness of 0.4 mm, dried, and pressed and molded with a roller press until each thickness of the both surfaces in the anode mix was 0.35 mm, and a negative plate, in which a packing density (D) of the anode mix per one piece was the negative plate of 0.23 g/cm$^2$, was made.

Figure 5:
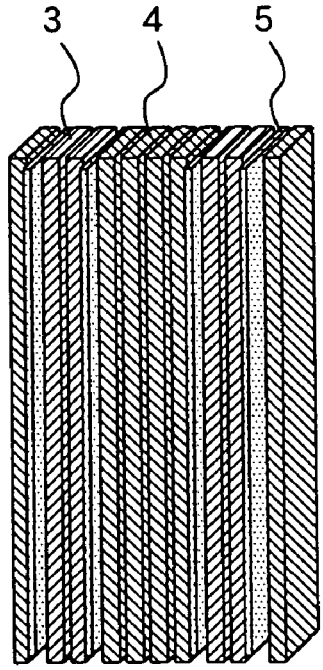
FIG. 5 is a perspective view showing an embodiment of a group of electrodes obtained by using the nonwoven fabric of the present invention.
Figure 6:
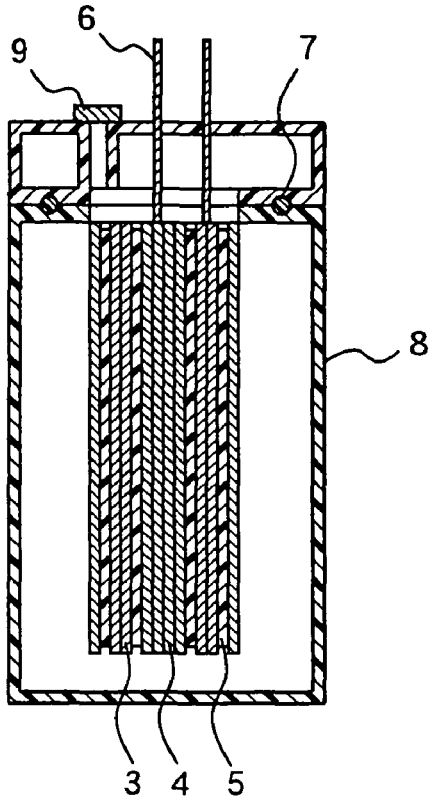
FIG. 6 is a schematic sectional view showing an embodiment of the battery of the present invention.

As shown in FIG. 5, the obtained positive plate 3 and the negative plate 4 were overlapped alternately through the separator 5 of Example 24 to make a group of electrodes. Further, as shown in FIG. 6, a lead wire (or wire lead) 6 was picked out from each electrode. Three pieces of such a group of electrodes were prepared, and, as shown in FIG. 6, put in an acrylic-armored can (or case) 8 equipped with a safety valve 9. In the can, a KOH aqueous solution having a specific gravity of 1.28 was poured and sealed through a gasket 7 to create a battery having a nominal capacity of 1000 mAh.

After aging at 60° C. for 2 days, the battery was charged at 10 hour rate for 15 hours, and discharged at 0.2 C until the terminal voltage become 1V. The charge and discharge was repeated three times. Table 9 shows the average value of the service capacity in the third cycle.

COMPARATIVE EXAMPLE 9

A battery was made in the same manner as in Example 29 except for using a separator produced in Comparative Example 8, and charged and discharged. Table 9 shows the average value of the service capacity in the third cycle.

TABLE 9

| | service capacity (mAh) |
|---|---|
| Ex. 29 | 920 |
| Com. Ex. 9 | 700 |

As apparent from the results shown in Table 9, the battery of Example 29 is high in service capacity compared with the battery of Comparative Example 9.

EXAMPLE 30

Figure 7:
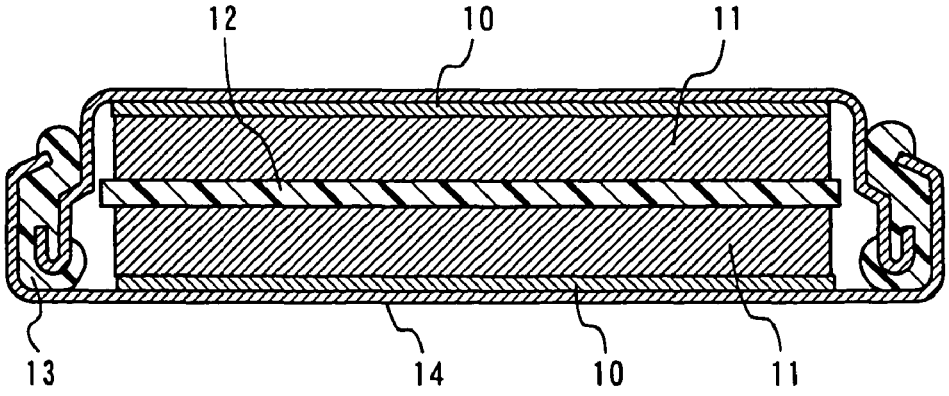
FIG. 7 is a schematic sectional view showing an embodiment of the capacitor of the present invention.

Ten (10) parts by weight of a polytetrafluoroethylene and 10 parts by weight of a conductive filler (manufactured by Denki Kagaku Kogyo Kabushiki Kaisha, "DENKA BLACK") were added to 80 parts by weight of an activated carbon (manufactured by Kuraray Chemical Co., Ltd., "BP-20"). The mixture was kneaded, formed into a sheet, and then the sheet was punched out to give a circular polarizable electrode having a diameter of 13 mm. The polarizable electrode was adhered to a can cover with a conductive paste, dried at 150° C. for 30 minutes, and then further vacuum-dried at 200° C. for 12 hours. Two circular separators each having a diameter of 13.5 mm were punched out of two separators of Example 24, respectively, vacuum-dried at 60° C., and then moved into a glove box being a dew point of not higher than −80° C. and henceforth operations for producing a cell (battery) were conducted in the glove box. As an electrolysis solution, a propylene carbonate solution containing tetraethylammonium tetrafluoroborate in a concentration of 1 M/L was used, and the polarizable electrode and the separator of Example 24 were impregnated in the electrolysis solution for 30 minutes. These materials were used to assemble a coin-shaped capacitor as shown in FIG. 7. In the coin-shaped capacitor, a pair of collecting members 10 and a pair of polarizable electrodes 11 are put in a case 14 through a separator 12, and the case 14 is sealed with a gasket 13.

The coin-shaped capacitor was charged and discharged up to 2.0V at a constant current of 4 mA, and an electrostatic capacity (or capacitance) was calculated based on a discharge curve from 1.0V to 0.5V in the discharge of the first cycle.

Moreover, a resistance was determined from a decreased voltage right after discharging. The results are shown in Table 10.

COMPARATIVE EXAMPLE 10

A capacitor was created in the same manner as in Example 30 except for using a separator produced in Comparative Example 8, and charged and discharged. Table 10 shows an average value of the electrostatic capacity.

TABLE 10

| | electrostatic capacity (mF) | Resistance (Ω) |
|---|---|---|
| Ex. 30 | 600 | 18 |
| Com. Ex. 10 | 500 | 75 |

As apparent from Table 10, the capacitor of Example 30 is high in electric capacity and is low in resistance, compared with the capacitor of Comparative Example 10.

What is claimed is:

1. A nonwoven fabric comprising:

ultra-fine continuous fibers of a water-insoluble thermoplastic resin having a mean fineness of not more than 0.5 dtex and a fine crimp; and a water-soluble thermoplastic polyvinyl alcohol in a proportion of 0.03 to 4.0% by weight relative to the nonwoven fabric;

wherein not less than 30% of the surface of the nonwoven fabric constitutes the water-soluble thermoplastic polyvinyl alcohol, wherein said nonwoven fabric has an absorbing height of 50 to 300 mm as determined at 20° C. after 10 minutes based on Byreck method when the nonwoven fabric is immersion-treated for 60 minutes in water at 80° C., and satisfies the following formula:

$$(B)/(A) \geqq 0.25$$

wherein the symbol (B) represents a tensile strength [N/5 cm] in the longitudinal direction and the lateral direction of the nonwoven fabric and the symbol (A) represents a fabric weight [g/m$^2$] of the nonwoven fabric, wherein said nonwoven fabric is produced by removing the water-soluble thermoplastic polyvinyl alcohol from a continuous conjugate fiber having a conjugate cross-section of an islands-in-the-sea-shaped form comprising a sea component composed of the water-soluble thermoplastic polyvinyl alcohol and an island component composed of the water-insoluble thermoplastic resin.

2. A nonwoven fabric according to claim 1, wherein the water-soluble thermoplastic polyvinyl alcohol comprises a modified polyvinyl alcohol containing at least one unit, in a proportion of 0.1 to 20 mol %, at least one member selected from the group consisting of an a-olefin unit having a carbon number of not more than 4 and a $C_{1-4}$ alkyl vinyl ether unit.

3. A nonwoven fabric according to claim 1, wherein the water-soluble thermoplastic polyvinyl alcohol comprises a modified polyvinyl alcohol containing 3 to 20 mol % of an ethylene unit.

4. A nonwoven fabric according to claim 1, wherein the proportion of the water-soluble thermoplastic polyvinyl alcohol relative to the nonwoven fabric is 0.03 to 3.5% by weight.

5. A nonwoven fabric according to claim 1, which is partially thermocompressed, and maintains the form of nonwoven fabric.

6. A nonwoven fabric according to claim 1, wherein the ultra-fine continuous fibers are entangled by jetting a pressurized water.

7. A nonwoven fabric according to claim 1, which comprises at least one thermoplastic resin selected from the group consisting of a polyester-series resin, a polyamide-series resin, a polyolefinic resin, and a modified polyvinyl alcohol containing an ethylene unit in a proportion of 25 to 70 mol %.

8. A nonwoven fabric according to claim 1, which is obtainable from a bundle of the ultra-fine continuous fibers.

9. A nonwoven fabric according to claim 1, which is obtainable from a bundle of the ultra-fine continuous fibers each having a fine crimp.

10. A laminate comprising a nonwoven fabric according to claim 1 and other nonwoven fabric.

11. A process for producing the nonwoven fabric of claim 1 comprising:

removing water-soluble thermoplastic polyvinyl alcohol from a continuous conjugate fiber having a conjugate cross-section of an islands-in-the-sea-shaped form comprising a sea component composed of the water-soluble thermoplastic polyvinyl alcohol and an island component composed of the water-insoluble thermoplastic resin.

12. The process according to claim 11, wherein the conjugate continuous fiber has a conjugate structure, in a cross section, Comprising:

an ultra-fine fiber component comprising the water-insoluble thermoplastic resin, and a water-soluble thermoplastic resin for separating or splitting the component into a plurality of isolated sections.

13. The process according to claim 11, wherein removing water-soluble thermoplastic polyvinyl alcohol comprises contacting the continuous conjugate fiber with a hydrophilic solvent for a time and under conditions sufficient to produce said non-woven fabric.

14. The process according to claim 13 further comprising drying the nonwoven fabric at a temperature not higher than 120° C. after removing water-soluble thermoplastic resin with the hydrophilic solvent.

15. The process according to claim 11, wherein removing water-soluble thermoplastic resin is conducted using 100, to 2,000 parts by weight of the hydrophilic solvent relative to 1 part by weight of the nonwoven fabric.

16. The process according to claim 11, wherein, removing water-soluble thermoplastic resin comprises dipping the nonwoven fabric or nonwoven web in the hydrophilic solvent of a temperature not higher than 50° C., gradually increasing the temperature of the hydrophilic solvent, and heat-treating the nonwoven fabric or nonwoven web in the hydrophilic solvent at a temperature of 80 to 120° C. for 5 minutes to 10 hours.

17. A wiper comprising a nonwoven fabric according to claim 1.

18. A filter material comprising a nonwoven fabric according to claim 1.

19. A battery or capacitor separator comprising a nonwoven fabric according to claim 1.

20. A battery comprising a separator according to claim 19.

21. A capacitor comprising a separator according to claim 19.

22. The nonwoven fabric of claim 1, wherein said ultrafine continuous fiber has a fine crimp of 1 to 50% which is produced by extracting the water-soluble thermoplastic polyvinyl alcohol in a hydrophilic solvent and gradually increasing the extraction temperature about 0.2 to 30° C. per minute.

23. The nonwoven fabric of claim 1, where said ultrafine continuous fiber has a fine crimp of about 1 to 30%.

24. The non-woven fabric of claim 1, wherein the amount of water-soluble thermoplastic polyvinyl alcohol ranges between 0.05 and 3%.

25. The non-woven fabric of claim 1, wherein the thermoplastic polymer is polypropylene and the amount of water-soluble thermoplastic polyvinyl alcohol ranges between 0.04 and 3.8%.

26. The non-woven fabric of claim 1, wherein the thermoplastic polymer is polypropylene and the amount of water-soluble thermoplastic polyvinyl alcohol ranges between 0.04 and 0.1%.

* * * * *

UNITED STATES PATENT AND TRADEMARK OFFICE

CERTIFICATE OF CORRECTION

PATENT NO. : 7,871,946 B2
APPLICATION NO. : 10/949452
DATED : January 18, 2011
INVENTOR(S) : Takuya Tsujimoto et al.

It is certified that error appears in the above-identified patent and that said Letters Patent is hereby corrected as shown below:

Column 41, line 56 should read --from the group consisting of an α-olefin unit having a carbon--.

Column 42, line 28 should read --section, comprising:--;

lines 44-45 should read --water-soluble thermoplastic resin is conducted using 100 to 2,000 parts by weight-- and line 47 should read --The process according to claim 11, wherein removing--.

Signed and Sealed this
Twenty-sixth Day of April, 2011

David J. Kappos

David J. Kappos
*Director of the United States Patent and Trademark Office*